US005634888A

United States Patent [19]

Henkin et al.

[11] Patent Number: 5,634,888

[45] Date of Patent: *Jun. 3, 1997

[54] HAND HELD TAP WATER POWERED WATER DISCHARGE APPARATUS

[76] Inventors: Melvyn L. Henkin, 5011 Donna Ave., Tarzana, Calif. 91356; Jordan M. Laby, 3038 Bayshore, Ventura, Calif. 93001

[ * ] Notice: The term of this patent shall not extend beyond the expiration date of Pat. No. 5,230,106.

[21] Appl. No.: 48,356

[22] Filed: Apr. 15, 1993

Related U.S. Application Data

[63] Continuation-in-part of Ser. No. 688,292, Apr. 22, 1991, Pat. No. 5,230,106.

[51] Int. Cl.[6] ..... A61H 7/00

[52] U.S. Cl. ..... 601/148; 601/155; 601/169

[58] Field of Search ..... 601/148, 149, 601/155, 156, 158, 160, 169; 239/447, 449

[56] References Cited

U.S. PATENT DOCUMENTS

| | | | |
|---|---|---|---|
| 3,802,422 | 4/1974 | Hurst | 601/160 |
| 3,998,390 | 12/1976 | Peterson | 601/169 |
| 4,204,543 | 5/1980 | Henderson . | |
| 4,204,646 | 5/1980 | Shames | 239/449 |
| 4,221,338 | 9/1980 | Shames | 239/449 |
| 4,441,488 | 4/1984 | Macabee | 601/160 |
| 4,458,676 | 7/1984 | Pileggi | 601/158 |
| 4,676,247 | 6/1987 | Van Cleve . | |
| 4,700,706 | 10/1987 | Münch . | |
| 4,726,080 | 2/1988 | Henkin | 601/169 |
| 4,854,319 | 8/1989 | Tobin . | |
| 4,926,510 | 5/1990 | Watkins | 601/148 |
| 4,933,999 | 6/1990 | Mikiya | 4/568 |
| 5,014,372 | 5/1991 | Thrasher | 601/169 |
| 5,088,487 | 2/1992 | Turner . | |
| 5,230,106 | 7/1993 | Henkin | 601/169 |

OTHER PUBLICATIONS

"The Doctors Book of Home Remedies" by Diamond, Ehrmantrout, Goldstein, Kunkel, Mathew, Saper, Sheftell, Solbach and Solomon, pp. (first sheet), 325, 239 and 328. Section Headaches.

*Primary Examiner*—Robert A. Hafer
*Assistant Examiner*—Brian E. Hanlon
*Attorney, Agent, or Firm*—Freilich, Hornbaker, Rosen

[57] ABSTRACT

A hand held apparatus particularly configured to derive maximum energy from a tap water supply (typically, ≧20 pounds per square inch) operating at a low flow rate (typically, ≧3.0 gallons per minute) to propel a discharge orifice along a travel path while discharging a water stream of sufficient intensity to impact a user's body to provide a pleasing massage. Preferred embodiments are characterized by a handle housing and a head housing mounted for relative movement with respect to one another for operating an internal mode selector valve. The selector valve directs the supplied tap water to either a hydromassage outlet or a shower spray outlet (e.g., continuous or pulsed spray).

32 Claims, 18 Drawing Sheets

20
22
26
28
30
32
40
42
43
44
45
46
47
48
49
50
51
52
53
57
60
66
68
70
72
74
76
78
80
84
86
89
94
96
97
105
106
107
108

HAND HELD TAP WATER POWERED WATER DISCHARGE APPARATUS

RELATED APPLICATIONS

This application is a CIP of application Ser. No. 688,292 filed Apr. 22, 1991, now U.S. Pat. No. 5,230,106, whose disclosure is by reference incorporated herein.

FIELD OF THE INVENTION

This invention relates to water discharge apparatus configured to be held in a user's hand, and powered by a tap water source for selective operation in a continuous shower spray mode, a pulsed shower spray mode, or a hydromassage mode.

BACKGROUND OF THE INVENTION

Many different structures are known in the prior art for discharging shower water sprays and massage water flows. For example only, many different hand held water discharge devices widely marketed through plumbing and hardware stores by various manufacturers are capable of selectively discharging either a continuous or pulsating shower spray. Other devices, primarily powered by electric pumps for use in hydrotherapy water tubs, are available for discharging water streams for impacting and massaging a user's body, e.g., the HYDROWAND marketed by HydroAir Industries, Inc. of Orange, Calif.

Still other devices for discharging water streams for massaging a user's body are disclosed in Applicants' following U.S. patents and the references cited therein:

| | |
|---|---|
| 4,679,258 | 4,731,887 |
| 4,689,839 | 4,763,367 |
| 4,692,950 | 4,813,086 |
| 4,715,071 | 4,825,854 |
| 4,726,080 | 4,965,893 |
| 4,727,605 | 4,982,459 |

The foregoing patents primarily disclose electric pump powered assemblies intended for mounting in a water tub wall for discharging a water stream through a discharge orifice. Some of the disclosed assemblies are configured so that the discharge orifice travels along a defined or random path. U.S. Pat. Nos. 4,689,839 and 4,726,080, whose disclosures are, by reference, incorporated herein, describe tap water powered hydrotherapy apparatus in which a water stream is discharged from a discharge orifice into a tub below the water surface and energy derived from the supplied tap water causes the discharge orifice to move along a travel path.

Applicants' parent application Ser. No. 688,292, now U.S. Pat. No. 5,230,106, discloses a hand held tap water powered water discharge apparatus selectively operable in a continuous shower mode, a pulsed shower mode, and a submergible hydromassage mode. The preferred apparatus described therein includes a sealed housing preferably configured to be held in a user's hand and mounted on the free end of a flexible tap water supply hose. A user operable mode selector valve determines the mode of the water discharged from the housing. A jet pump is mounted in the housing which, in the hydromassage mode, uses the supplied tap water to entrain tub water. The combined tap-tub water flow is then used to entrain air to form a water-air stream, which is discharged from the housing for massaging a user's body. The preferred apparatus includes a discharge orifice mounted for movement along a travel path as the water stream is discharged therefrom.

A related apparatus is described in Applicants' U.S. application Ser. No. 688,043, filed Apr. 19, 1991, now U.S. Pat. No. 5,197,459. This application describes an electric pump powered submergible hand held apparatus for discharging a water stream for massaging a user's body. The apparatus includes a hand held housing mounted on the free end of a flexible hose. An electric pump draws in tub water and supplies it under pressure for flow through the hose to a nozzle which discharges a water jet into a cavity to create a suction therein. The suction is able to draw air and/or tub water into the cavity for mixing with the water jet discharged from the nozzle. Valve means are provided enabling the user to selectively open either the air port (to cause air entrainment) or the tub water port (to cause water entrainment). The housing preferably includes a discharge orifice mounted for movement along a travel path as the water stream is discharged therefrom.

The references cited in the prosecution histories of said applications Ser. Nos. 688,292 and 688,043 describe a variety of hand held devices for discharging water streams for impacting against a user's body. One device of particular interest is discussed in U.S. Pat. No. 5,031,256 issued Jul. 16, 1991, entitled "Jet Nozzle Attachment" by Mikiya, and in his related patents U.S. Pat. Nos. 4,933,999 and 5,058,220. These patents discuss a hand held jet nozzle attachment intended to be coupled via a hose to a compressed hot water jet hole. The attachment includes a change-over valve 16 which can be operated by the user to direct a supplied jet stream out through either a jet hole 26 for massage or past an impeller to a plurality of shower jet holes 32. Air is introduced downstream from the change-over valve 16 for mixing with the supplied jet stream, i.e., via path 50 (FIG. 11) into chamber 25, to form the massage stream prior to discharge through jet hole 26.

Another device of interest is discussed in U.S. Pat. No. 4,985,943 issued Jan. 22, 1991, entitled "Two-Stage Adjustable Hydrotherapeutic Jet and Method", by Tobias. This patent discusses an electric pump powered jet assembly intended to be mounted to a water tub wall. The assembly employs three nozzles and two separate mixing chambers. A primary stream of water flows through the first nozzle to create a low pressure condition which sucks air into the first mixing chamber. The primary stream comprising a water-air mixture is discharged through the second nozzle into the second mixing chamber, thereby creating another low pressure condition which sucks a secondary stream of water from the tub into the second mixing chamber and hence causes the aerated primary stream to be entrained with the secondary stream. The air/water mixture is then discharged from the second mixing chamber into the tub via the third nozzle.

A still further device of interest is described in U.S. Pat. No. 4,508,665 by Spinnett which shows a cylindrical member mounted for rotation and defining a passageway therethrough configured so that water and air flow through the passageway causes the member to rotate.

Tap water powered water discharge devices, as contrasted with electric pump powered devices should be capable of operating at supply pressures as low as 20 pounds per square inch (p.s.i.) and at relatively low flow rates, e.g., equal to or less than 3.0 gallons per minute (g.p.m.), because of the limited quantity of hot water usually available and the general appropriateness of conserving water. In order to achieve satisfactory hydromassage action at these pressures and flow rates, it is essential to derive as much energy as possible from the tap water supply flow.

Additional U.S. patents of interest include:

U.S. Pat. No. 3,528,411
U.S. Pat. No. 3,530,852
U.S. Pat. No. 3,802,442
U.S. Pat. No. 3,868,949
U.S. Pat. No. 4,209,132
U.S. Pat. No. 4,441,488
U.S. Pat. No. 4,640,462
U.S. Pat. No. 4,709,691
U.S. Pat. No. 4,908,888
U.S. Pat. No. 4,926,510
U.S. Pat. No. 5,054,474
U.S. Pat. No. 5,070,864

SUMMARY OF THE INVENTION

Accordingly, the present invention is directed to an improved hand held apparatus particularly configured to derive maximum energy from a tap water supply (typically, ≧20 pounds per square inch) operating at a low flow rate (typically, ≦3.0 gallons per minute) to propel a discharge orifice along a travel path while discharging a water stream of sufficient intensity to impact a user's body to provide a pleasing massage.

Preferred embodiments of the invention are characterized by a handle housing and a head housing mounted for relative movement with respect to one another for operating an internal mode selector valve. The selector valve directs the supplied tap water to either a hydromassage outlet or a shower spray outlet (e.g., continuous or pulsed spray).

In accordance with a preferred embodiment, the supplied tap water flows directly through a restricted cross-section orifice (preferably ≦3/16 inch diameter) into an internal cavity. By functioning both to restrict tap water flow (to ≦3.0 g.p.m.) and to convert the relatively high pressure low velocity tap water to a low pressure high velocity input to the cavity, the full energy of the supply flow is available for entraining air and/or tub water. A mode selector valve is located downstream from the cavity inlets for selectively directing the water stream from the cavity through either a hydromassage outlet or shower outlet.

In accordance with preferred embodiments of the invention, the cavity hydromassage outlet is oriented proximate to, and substantially aligned with, the entrance to a hydromassage passageway formed in a member mounted for rotation. The hydromassage passageway is configured to direct the water flow therethrough to a discharge orifice so as to produce a moment arm about the axis of rotation to cause the passageway member to rotate and move the discharge orifice along a circular travel path. Preferred embodiments of the invention are capable of operating to discharge said hydromassage stream either underwater or out of water.

In accordance with one preferred embodiment of the invention, first and second successive internal cavities are provided with air being supplied for entrainment in said first cavity and tub water being supplied for entrainment in said second cavity.

In accordance with a useful feature of a preferred embodiment, a flexible membrane is mounted adjacent to the discharge orifice for limiting water splash while still affording a pleasing massage. As the discharge orifice moves along its travel path, the hydromassage stream emanating from the discharge orifice impacts the rear face of the membrane to transfer a force therethrough. By holding the front face of the membrane against a user's body, the user will experience a pleasing massage. The membrane is preferably supported on a frame mounted adjacent to the discharge orifice and configured so as to not restrict the outflow from the discharge orifice while avoiding splashing which might otherwise occur, when a hydromassage stream directly impacts a user's body.

In accordance with a further feature, embodiments of the invention are provided with a protuberance having a contact surface located forwardly of the discharge orifice for engaging and mechanically massaging a user's body in reaction to the laterally directed force produced by the hydromassage stream discharged from the moving discharge orifice. An eccentric weight is preferably mounted on the rotating passageway member to enhance the mechanical massaging effect.

In accordance with a further aspect of a preferred embodiment, a preplumbed subassembly is provided configured for easy coupling to installed system plumbing through an opening in the deck of a water tub. The subassembly includes a plate carrying one or more valve bodies which extend below the plate into the deck opening. One or more valve control knobs project above the plate. Piping in the subassembly connects a tap water source to the entrance of a flexible hose coupled through an opening in the plate to a hand held apparatus in accordance with the invention. The mouth of a flexible bag is sealed around the opening in the plate below the deck to collect water drippings from the outer surface of the hose which, in normal use, is pulled outwardly through the plate opening and submerged in the tub water pool when the hand held apparatus is used for underwater hydromassage.

To facilitate an understanding of the Detailed Description, the following Table I relates the various embodiments to the several figures and summarily shows the modes and hydromassage entrainment capabilities of each:

TABLE I

Figure 3:
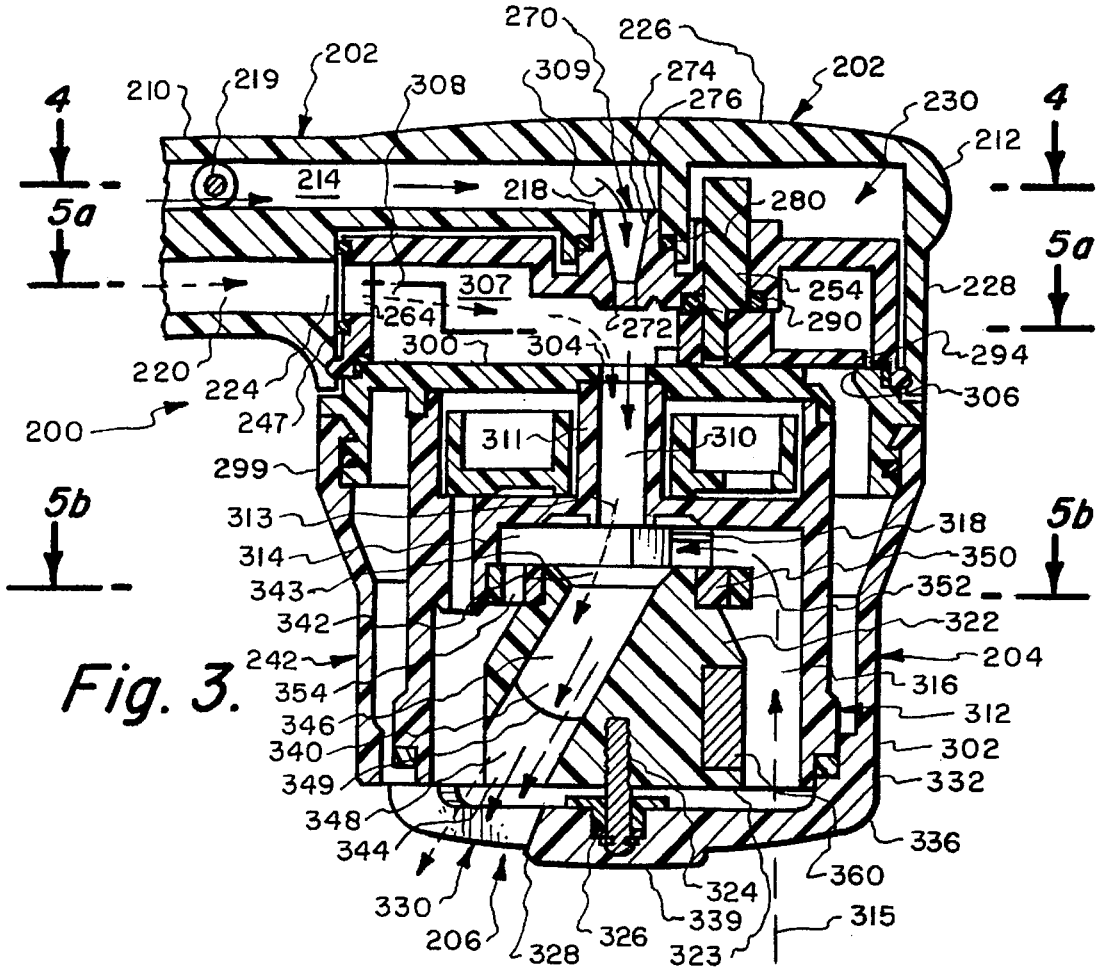
FIG. 3 is a sectional view taken substantially along the plane 3—3 of FIG. 2 showing the internal structure of the water discharge apparatus with the valving set for the hydromassage mode and for both air and tub water entrainment.

| EMBODIMENT | FIGURES | MODE | ENTRAINMENT AIR | ENTRAINMENT TUBWATER | COMMENTS |
|---|---|---|---|---|---|
| 1 | 2–5 | Hydromassage | ✓ | ✓ | ‖ |
| | 8–10 | Hydromassage | — | ✓ | ‖ |
| | 11–13 | Pulse Shower | — | — | ‖crank valve adjusting |
| | 14–16 | Continuous Shower | — | — | ‖mechanism |
| 2 | 17 | Hydromassage | ✓ | N/A | ‖ |
| | (not shown) | Pulse Shower | — | N/A | ‖crank valve adjusting |
| | (not shown) | Continuous Shower | — | N/A | ‖mechanism |
| 3 | 18,19 | Hydromassage | ✓ | ✓ | ‖FIG. 3+ |
| | (not shown) | Pulse Shower | — | — | ‖membrane |
| | (not shown) | Continuous Shower | — | — | ‖ |
| 4 | 20–23 | Hydromassage | ✓ | ✓ | ‖ |
| | (not shown) | Pulse Shower | — | — | ‖gear drive valve adjusting |
| | (not shown) | Continuous Shower | — | — | ‖mechanism |
| 5 | 24–27 | Hydromassage | N/A | ✓ | ‖apertured |
| | 28,29 | Pulse Shower | N/A | — | ‖cylinder valve |
| | 30,31 | Continuous Shower | N/A | — | ‖ |
| 6 | 32 | Hydromassage | N/A | N/A | ‖apertured |
| | (not shown) | Pulse Shower | N/A | N/A | ‖cylinder valve |
| | (not shown) | Continuous Shower | N/A | N/A | ‖ |

DETAILED DESCRIPTION

Figures 1A, 1B:
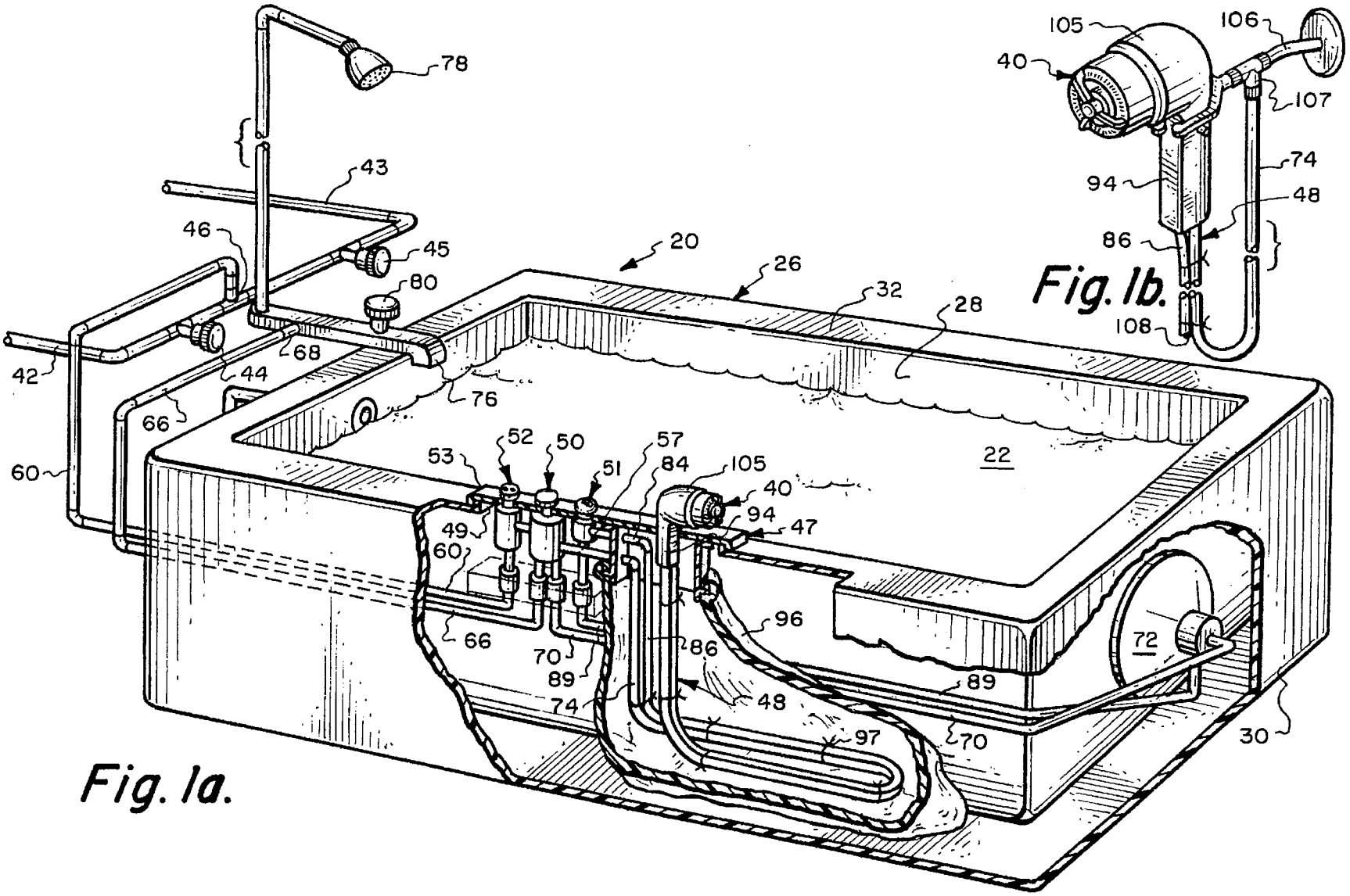
FIG. 1*a* is an isometric view, partially broken away, showing a hand held water discharge apparatus in accordance with the invention installed in a bathtub.
FIG. 1*b* is an isometric view of a hand held water discharge apparatus in accordance with the invention mounted on a shower arm.

Attention is now directed to FIG. 1*a* which illustrates an exemplary water tub 20 for accommodating a pool of water 22 in which a user can sit. The water tub includes a wall 26 essentially comprised of an inner wall portion 28, an outer wall portion 30, and a deck wall portion 32.

The present invention is primarily directed to a hand held unit 40 designed to enable a user to selectively discharge either a continuous shower spray, a pulsed shower spray, or a hydromassage water stream. In contrast to many electric pump driven hydromassage units known in the prior art, embodiments of the present invention are driven by pressurized tap water supplied at a pressure≧20 p.s.i. from conventional supply pipes represented in FIG. 1*a* by hot water pipe 42 and cold water pipe 43. The pipes 42,43 respectively supply tap water via control valves 44, 45 to a common coupler 46.

In accordance with a preferred embodiment of the invention, a deck mount water distribution subassembly 47 (FIGS. 1*a*,1*c*) is provided for efficiently installing the hand held unit 40, coupled to the end of flexible hose 48, in water tub 20. The subassembly 47 is intended for "drop-in" installation through an opening 49 in deck 32, as shown in FIG. 1*a*. The subassembly 47 preferably includes a device-selector valve 50, an air control valve 51, and an anti-siphon valve 52, all mounted on a plate 53. Plate 53 is configured to rest on deck 32 above opening 49 with the bodies of valves 50, 51, 52 projecting downwardly therefrom. The selector valve 50 includes inlet nipple 54 and outlet nipples 55, 56, 57. Pipe 60 supplies pressurized tap water from coupler 46 to inlet nipple 54 via anti siphon valve 52 having an inlet 61 and outlet 62. Selector knob 64 selectively directs the supplied tap water (1) via nipple 55 to pipe 66 for connection to faucet-shower nipple 68, or (2) via nipple 56 through pipe 70 to a hydromassage unit 72 mounted in tub inner wall 28 and/or (3) nipple 57 through the water lumen 74 of flexible hose 48 to hand held unit 40. The selector knob 64 is preferably configured to allow a user to variably control the flow rate of the tap water supplied through valve 50.

The anti-siphon valve 52 can, for example, be of the type depicted in FIG. 3A of parent application Ser. No. 688,292. The hydromassage unit 72, can for example, be of the type depicted in Applicant's U.S. Pat. No. 4,689,839.

When the selector knob 64 is in its first position, tap water is supplied via pipe 60 to nipple 68 and is then discharged in a conventional manner either through spout 76 or shower head 78, depending on the position of conventional user controlled valve 80.

Figure 1C:
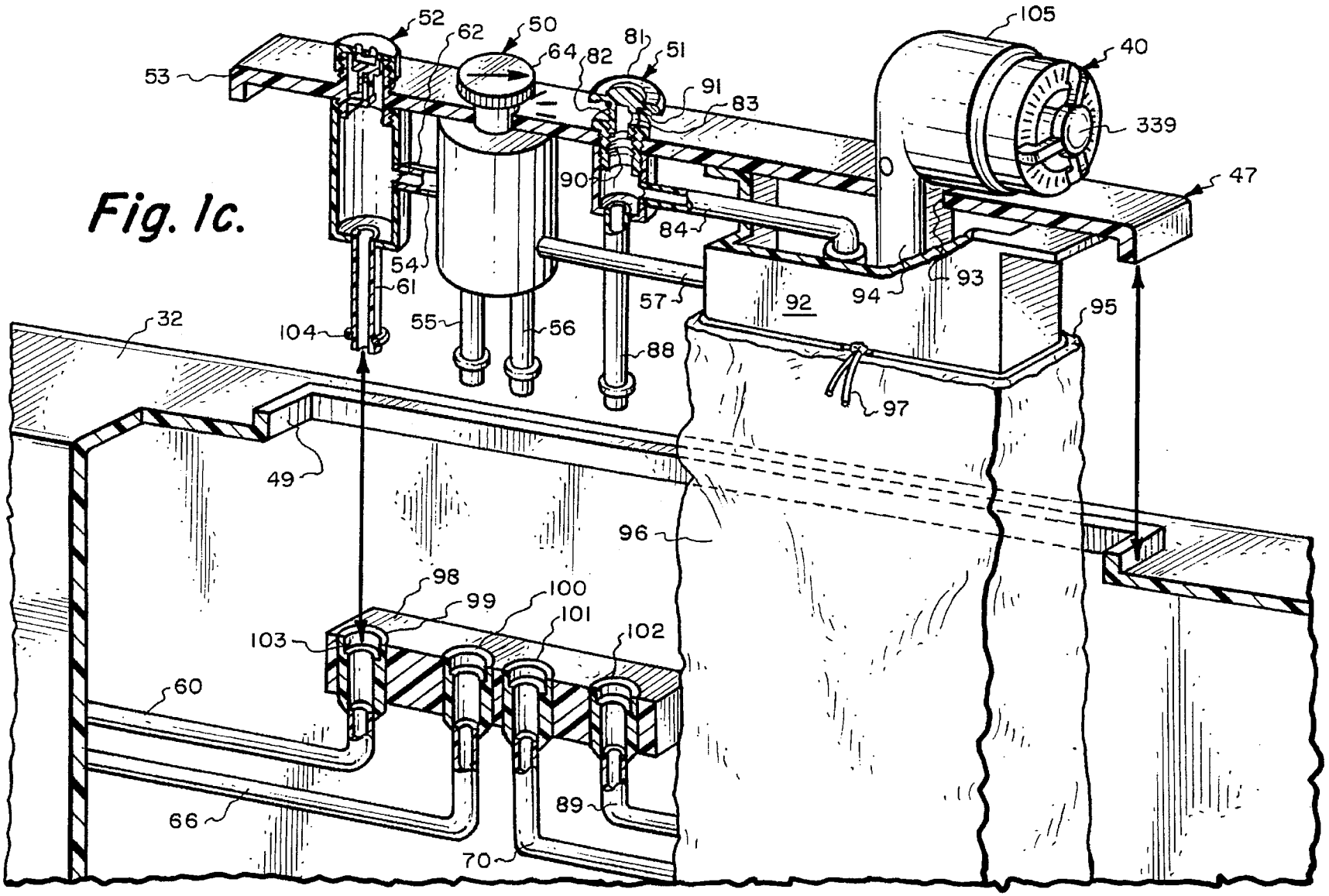
FIG. 1*c* is an exploded isometric view of a water distribution deck mount subassembly for facilitating installation of a hand held apparatus in accordance with the invention.

The air control valve 51 includes a control knob 81 mounted on the upper end of threaded hollow shaft 82 having an air hole 83 extending laterally through it. When the shaft is raised as shown in FIG. 1*c*, air enters through air hole 83 and is supplied to (1) hand held unit 40 via outlet nipple 84 and air lumen 86 of flexible hose 48 and/or (2) hydromassage unit 72 via outlet nipple 88 and pipe 89. When shaft 82 is threaded down into threaded insert 90, the air hole is sealed by O-ring 91 bearing against the flange of insert 90. The user can variably control the amount of air flowing into air hole 83 by controlling the threading of shaft 82 into insert 90 and thus the relative sealing of the air hole by O-ring 91.

The subassembly 47 includes a peripheral wall 92 depending from the lower surface of plate 53 surrounding an opening 93 in the plate. The opening 93 is dimensioned to accommodate an elongate handle portion 94 of the hand held unit 40 as shown in FIGS. 1*a* and 1*c*. The mouth 95 of a closed container 96, e.g., a flexible bag, is secured around the peripheral wall 92. The aforementioned selector valve nipple 57 and air valve nipple 84 extend through peripheral wall 92 into the volume enclosed by wall 92 and container 96 and are respectively terminally coupled to aforementioned hose lumens 74 and 86. The lumens 74, 86 are preferably bound together along their length by ties 97 to form the composite hose 48 connected to the hand held unit 40.

As shown in FIG. 1*c*, a coupling block 98 is provided mounted beneath the deck opening 49 between inner and outer wall portions 28, 30. The coupling block 98 defines couplers 99, 100, 101, 102 whose lower ends are terminally coupled to pipes 60, 66, 70, 89, respectively. The couplers upper ends are open for respectively receiving nipples 61, 55, 56, 88, as shown in FIG. 1*c*, when the subassembly 47 is lowered into deck opening 49. Each of the nipples 61, 55, 56, 88 carries an O-ring 104 which seals against the inner wall 103 of the mating coupler.

In use, the hand held unit 40 is lifted from the plate 53 drawing the hose 48 outwardly through opening 93. The user may frequently submerge the unit 40 below the surface of water pool 22 when operating in the hydromassage mode, causing the exterior of hose 48 to get wet. The bag 96 which accommodates the hose 48 will catch the drippings therefrom. When the unit 40 is not in use, the user will thread the hose 48 back through plate opening 93 into the bag 96 leaving the handle portion 94 in the opening 93 and the attached enlarged portion 105 extending above the deck 32.

As previously mentioned, a preferred hand held embodiment 40 in accordance with the invention is selectively operable in a continuous shower mode, a pulsed shower mode, or a hydromassage mode. As will be seen hereinafter, the apparatus 40 is preferably constructed of mating handle and head housings configured so that relative rotation therebetween operates an internal mode selector valve enabling a user to select any one of these three operational modes.

FIG. 1*b* illustrates the hand held unit 40 alternatively installed on a conventional wall mounted shower supply pipe 106. A preferred T-shaped adapter 107, preferably incorporating an anti-siphon valve as shown in FIG. 3 of said parent Application, couples the supply pipe 106 to water lumen 74 of hose 48. The air lumen 86 is left open at 108.

FIRST EMBODIMENT (FIGS. 2–16)

Figure 2:
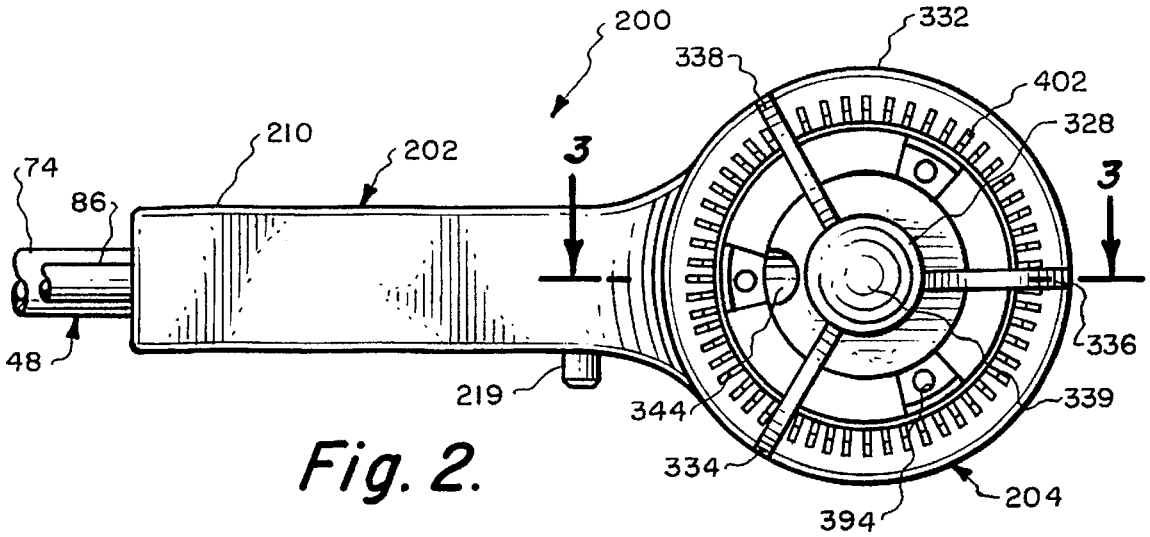
FIG. 2 is a bottom plan view of the handle and head housings of a first embodiment of water discharge apparatus in accordance with the invention operable to selectively discharge a hydromassage stream or continuous or pulse shower sprays.
Figure 7:
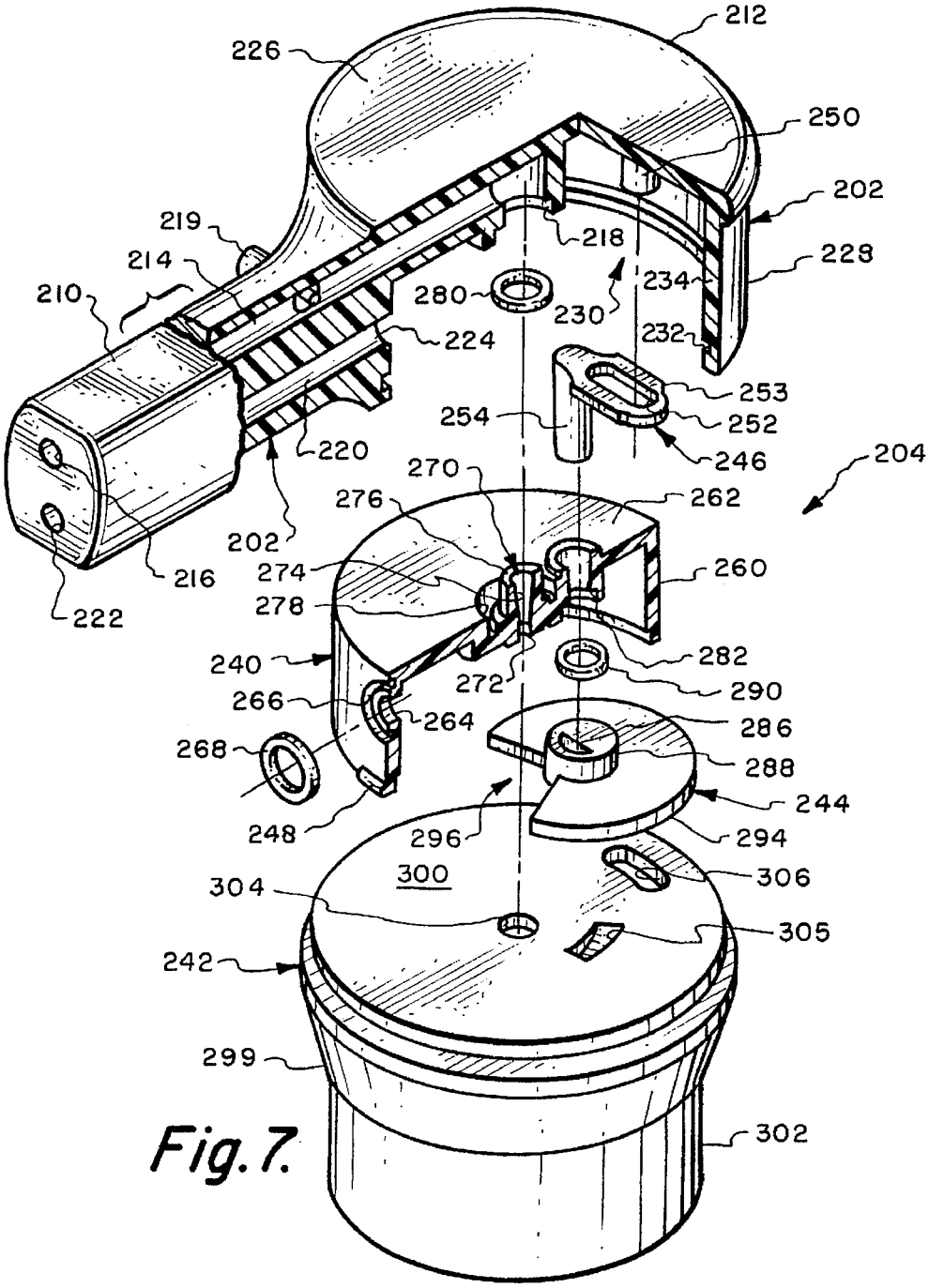
FIG. 7 is an exploded isometric view primarily showing the internal structure of the handle and head housings.

Attention is now directed to FIGS. 2–16 which illustrate a first embodiment 200 of a hand held apparatus 40 in accordance with the invention and in particular initially to FIGS. 2, 3 and 7. The apparatus 200 is basically comprised of a handle housing 202 and a head housing 204. As will be explained in detail hereinafter, the handle housing 202 is mounted on the end of supply hose 48 to supply both air and water to the head housing 204 for discharge either through shower hole openings or a hydromassage discharge orifice proximate to the front face 206 of the head housing. Briefly, the handle housing 202 and head housing 204 are mounted to each other for relative rotational movement by the user to control valved passages which establish the operating mode of the apparatus 200.

The handle housing 202 (FIG. 7) is comprised of an elongate handle portion 210 and a substantially cylindrical interface portion 212, preferably integrally formed as represented in the figures. The handle portion 210 defines an internal elongate water passageway 214 extending from an externally accessible water supply entrance 216 to an internal water supply exit port 218. A slide valve 219 is mounted in passageway 214 to permit a user to variably control the flow therepast. The handle portion 210 additionally includes an internal elongate air supply passageway 220 similarly extending from an externally accessible air supply entrance 222 to an internal air supply exit port 224.

The cylindrical interface portion 212 is defined by a cover plate 226 and a depending annular wall 228. The cover plate 226 and depending wall 228 together essentially define a compartment 230 for receiving a portion of the aforementioned head housing 204, as is best depicted in FIGS. 3 and 7. An annular slot 232 is formed in the wall 228 extending radially outwardly from the wall inner surface 234.

The head housing 204 comprises an assembly of parts including primarily an inlet member 240, a discharge member 242, a valve member 244, and a crank mechanism 246 for moving the valve member 244. The details of these head housing members will be discussed at length hereinafter. Suffice it to say at this point, the inlet member 240 is mounted on and secured to, as by gluing at 247, the discharge member 242, with the valve member 244 mounted therebetween.

The head housing portion 204, and particularly the inlet member 240, is configured to be accommodated in the compartment 230 defined by cover plate 226 and depending wall 228, as shown in FIG. 3. The head housing 204 is primarily retained in the compartment 230 by a radially outwardly extending annular ring 248 formed on inlet member 240 which snaps into annular slot 232 formed in the inner surface 234 of wall 228. The engagement of the annular ring 248 in the annular slot 232 permits relative rotation between the handle housing 202 and head housing 204 with respect to an axis common to the ring and slot 248, 232. When the head housing 204 is accommodated in the compartment 230, a valve control pin 250 depending into the compartment 230 from cover plate 226, is engaged in slot 252 formed in pin follower arm 253 of crank mechanism 246. The shaft 254 attached to arm 253 is secured to valve member 244 such that relative rotation between the handle housing 202 and head housing 204 rotates the valve member 244 with respect to the discharge member 242.

With continuing reference to inlet member 240, note that it is comprised primarily of a cylindrical wall 260 depending from a circular cover plate 262. The wall 260 contains an aperture 264 comprising an air inlet. Note that when the head housing 204 is accommodated in the handle housing 202 as depicted in FIG. 3, the air inlet 264 is vertically aligned with the air exit 224 of air passageway 220. Note that an annular recess 266 is preferably formed around air inlet 264 to accommodate an O-ring 268.

The plate cover 262 of inlet member 240 defines a central opening 270 comprising a water inlet depicted as including a restricted cross section orifice 272 (≦3/16 inch) and a converging tubular section 274. The water inlet is defined by annular wall 276 projecting from plate 262. Note in FIG. 3 that when the head housing 204 is assembled to the handle housing 202, the annular wall 276 projects into the water exit port 218 of water passageway 214. An annular recess 278 around wall 276 accommodates on O-ring 280.

The plate 262 defines a second opening 282 extending therethrough. Note that opening 282 is radially displaced from the water inlet 270 which as illustrated is preferably located coincident with the axis of rotation of the handle and head housings 202, 204. The opening 282 accommodates the crank shaft 254 for rotation therein. The lower extremity of the shaft 254 is configured with a noncircular cross section, e.g., semi-circular, in order to be accommodated in a similarly configured recess 286 formed in boss 288 of the valve member 244. An O-ring 290 is preferably accommodated around the shaft 254. It should be apparent that as the shaft 254 is rotated within opening 282, it will in turn rotate boss 288. Boss 288 carries a disk valve element 294 which extends approximately 270 degrees around the boss. This of course leaves approximately a 90 degree open sector 296.

The discharge member 242 comprises an outer essentially cylindrically shaped body 299 having a top plate 300 and a depending cylindrical wall 302. The top plate 300 defines three openings 304, 305, 306 (FIG. 7) which, as will be understood hereinafter, respectively comprise a hydromassage outlet, a pulsed shower outlet, and a continuous shower outlet.

The openings 304, 305, 306 are referred to as "outlets" because they comprise the ports from which water exits from cavity 307. More particularly, when the inlet member 240 is mounted on the discharge member 242 in its assembled condition as depicted in FIG. 3, the volume defined between the discharge member top plate 300 and the inlet member cover plate 262 forms a cavity 307 in which air 308 entering the cavity via inlet 264 is entrained by high velocity water 309 entering the cavity via the restricted cross section orifice 272. Water from the cavity 307 will exit through outlets 304, 305, or 306 depending upon the rotational position of valve element 294. That is, the configuration of valve element 294 is such that all of the outlets will be sealed except the outlet aligned with the open sector 296.

As shown in FIG. 3, outlet 304 is aligned with a central straight wall passageway 310 defined by annular wall 311 projecting axially from an inner essentially cylindrically shaped body 312 of discharge member 242. Passageway 310 exits at port 313 into a second cavity 314. Whereas the initially mentioned cavity 307 functions to entrain air, cavity 314 is used to entrain tub water when the apparatus 200 is being operated in the hydromassage mode submerged below the surface of the water pool 22 (FIG. 1). Flow arrows 315 in FIG. 3 represent tub water flowing via passageways 316 and ports 318 into cavity 314.

Mounted for rotation within the head housing 204 is a substantially cylindrical member 322. The member 322 comprises a substantially cylindrical block having a front face 323 secured to axial pin 324. Pin 324 is in turn mounted for rotation in bearing 326 secured in a hub 328 of a frame 330 defined by an outer ring 332 and multiple legs 334, 336 and 338 extending radially from the hub 328 to the outer ring 332. The hub 328 comprises a protuberance defining a forwardly projecting, front surface 339 which is useful for mechanically massaging a user, as will be discussed hereinafter.

A hydromassage passageway 340 is defined in the cylindrical member 322 extending between an entrance orifice 342 formed in the rear face 343 of member 322, and a discharge orifice 344 formed in the front face 323 of the member 322. Note that the passageway 340 includes a first elongate portion 346 oriented at a first acute angle relative to the rotation axis defined by pin 324 and a second elongate portion 348 which deviates at 349 at an acute angle relative to portion 346. Note that the discharge orifice 344 defined by elongate passageway portion 348 is radially displaced from the pin 324. Thus, water flowing into hydromassage passageway entrance 342 will traverse passageway portions 346 and 348 prior to exiting at discharge orifice 344. The directional change imposed on the water flow traversing passages 346 and 348 creates a tangentially directed moment arm about the axis defined by pin 324 to rotate member 322 about the axis. Note that the member 322 carries a bearing ring 350 adjacent its rear face which rotates within a fixed outer bearing ring 352. The inner bearing ring 350 is preferably eccentrically configured to define a high point 353 oriented opposite to the discharge orifice 344. This creates a space 354 between the bearing rings in which a small amount of water can be drawn into the cavity 314 for lubricating the adjacent bearing ring surfaces.

It is pointed out that the cylindrical member 322 carries an eccentrically mounted weight 360 proximate to its peripheral surface. The purpose of this weight is to enhance the mechanical massaging afforded by the protuberance 328 when the apparatus 200 is operated in the hydromassage mode depicted in FIG. 3. The protuberance 328 preferably defines a smooth end surface 339 intended to be placed against the user's skin for mechanical massaging. More particularly, as the member 322 rotates in response to the discharge of the water stream from discharge orifice 344, the stream will produce a reaction force which continually changes direction and causes the protuberance 328 to move.

By applying firm, but gentle, pressure of the protuberance surface 339 against the user's skin, the protuberance will mechanically massage the suer while the water stream discharged from orifice 344 directly provides a hydromassage. The eccentric weight 360 exaggerates this motion to enhance the mechanical massaging effect, supplementing the hydromassage effect produced by the stream emanating from the discharge orifice 344 as it moves along its circular travel path around the axis defined by pin 324.

Figure 4:
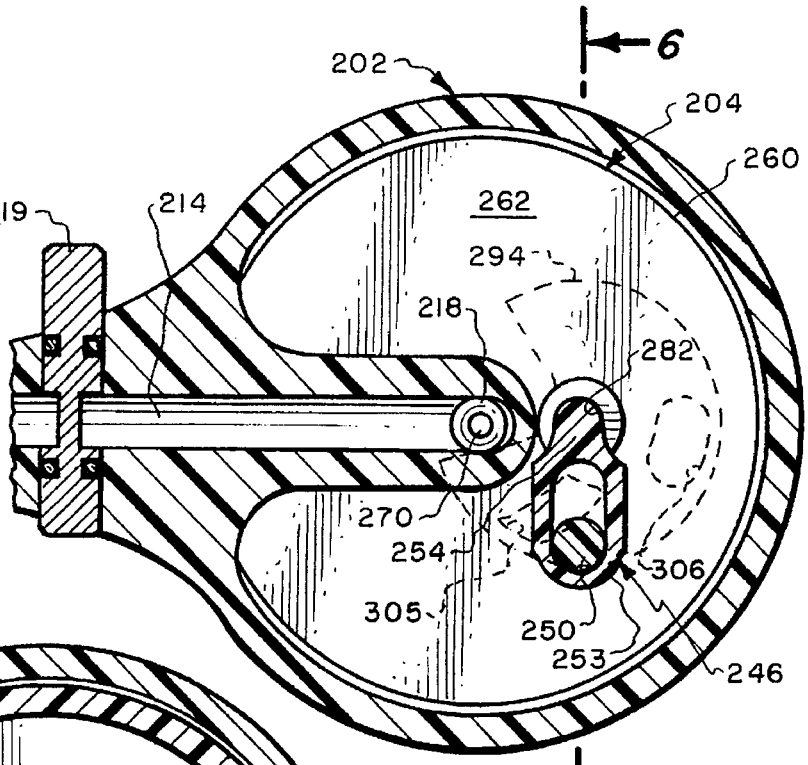
FIG. 4 is a sectional view taken substantially along the plane 4—4 of FIG. 3.
Figure 5A:
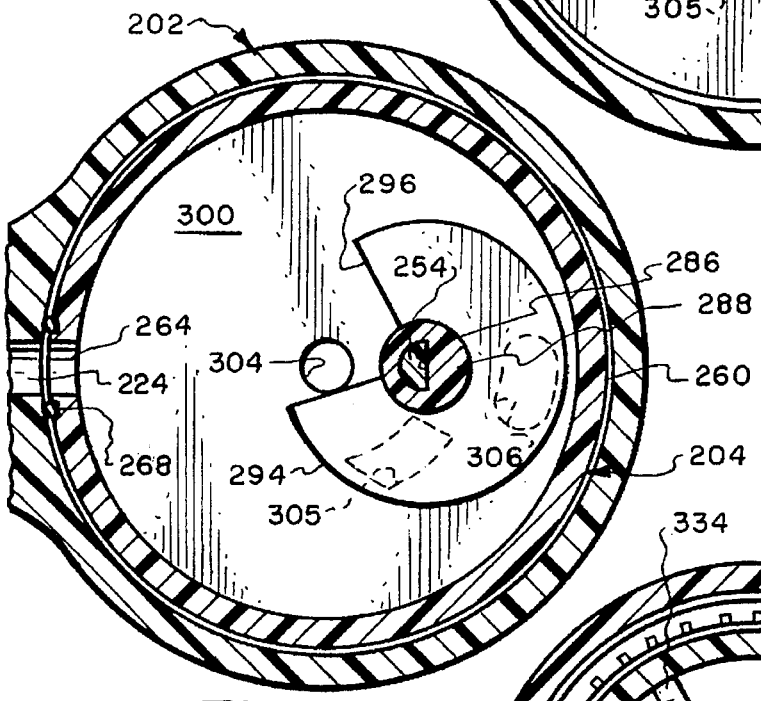
FIG. 5*a* is a sectional view taken substantially along the plane 5*a*—5*a* of FIG. 3.
Figure 5B:
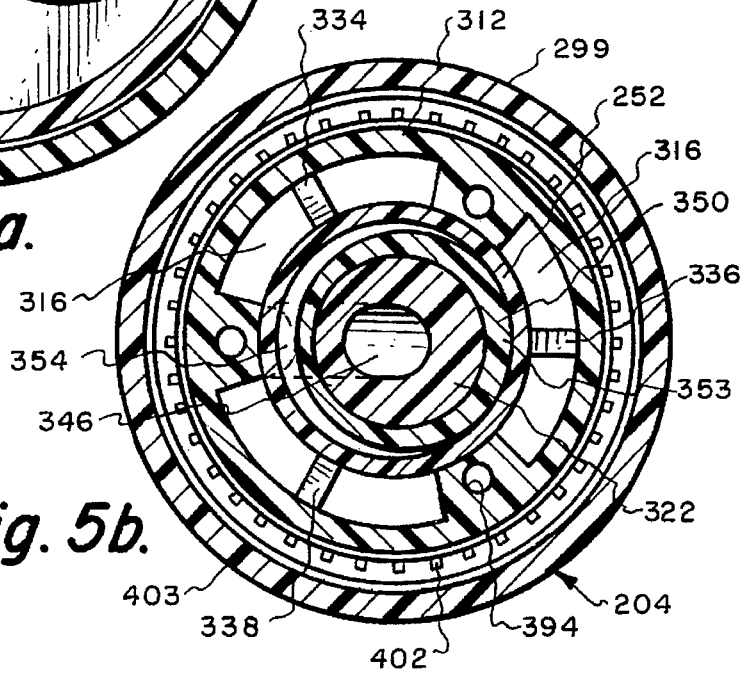
FIG. 5*b* is a sectional view taken substantially along the plane 5*b*—5*b* of FIG. 3.
Figure 6:
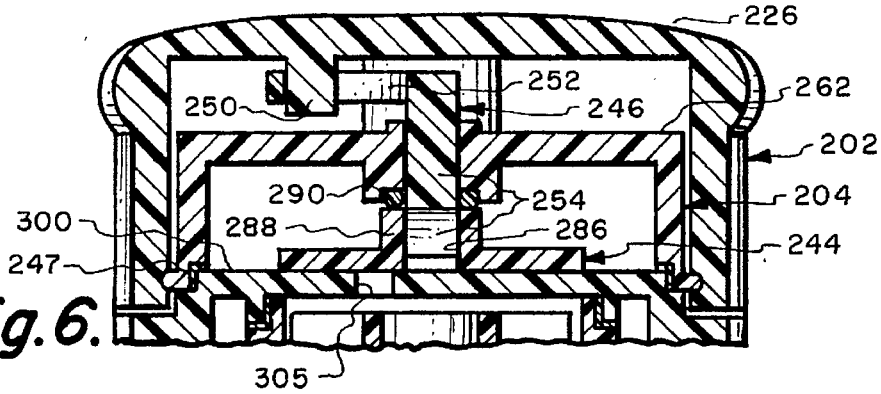
FIG. 6 is a sectional view taken substantially along the plane 6—6 of FIG. 4.

Before proceeding to a discussion of FIGS. 8–16, which illustrate the embodiment 200 in different modes of operation, the operation of the apparatus in the hydromassage mode with both air and water entrainment, as depicted in FIG. 3 will be explained. Tap water at a pressure ≧20 p.s.i. is supplied by lumen 74 to the tap water supply entrance 216 in the handle portion 210. This tap water flow exits from the water supply passageway 214 at 218 and enters the water inlet 270. For a given water pressure, the flow rate into cavity 307 is primarily determined by the cross sectional area of the restricted orifice 272. In order to provide a pleasing hydromassage and shower effect, while also conserving water usage, orifice 272 is dimensioned (preferably ≦3/16 inch) to limit the flow into cavity 307 to 3.0 gallons per minute or less. The restricted cross section orifice 272 causes the water exiting from the orifice 272 to enter the cavity 307 at a high velocity. Air supplied via passageway 220 enters the cavity 307 via air inlet 264 and is entrained by the discharge from orifice 272. The high velocity water-air mixture exits from the cavity 307 via outlet 304 into straight wall passageway 310. Note in FIG. 5*a*, corresponding to FIG. 3, that only outlet 304 is open. That is, pulsed shower outlet 305 and continuous shower outlet 306 are covered and sealed by the valve element 294 whose position is established, as shown in FIG. 4, by the rotational orientation of slotted crank arm 253 which follows the position of pin 250 depending from the cover plate 226 of handle housing 202 (FIG. 7).

The high velocity flow from passageway 310 enters the second cavity 314 where it entrains tub water, represented by flow arrows 315, and the tap water-air-tub water mixture then exits from cavity 314 and enters the hydromassage passageway entrance 342. As previously pointed out, the water stream traversing the hydromassage passageway 340 produces a laterally directed thrust displaced from the axis of rotation, i.e., tangential, defined by pin 324 to thus rotate the member 322 about pin 324, thereby moving the discharge orifice 344 along a circular travel path. By placing the front face of the apparatus close to the user's body, the water stream discharging from discharge orifice 344 will massage the user's body over an area substantially defined by the travel path of orifice 344. The hydromassage is supplemented by a mechanical massage by placing the protuberance face 339 against the user's skin, as previously described.

Before proceeding to an explanation of FIGS. 8–16 which illustrate the apparatus 200 in different modes of operation, it is pointed out that by locating the mode selector valve 244, downstream from the first air entraining cavity 307, the maximum amount of energy from the tap water flow is available for producing the hydromassage. That is, there is essentially no energy loss in the tap water flow transitioning from water supply passageway 214 into cavity 307. The restricted cross section orifice 272 efficiently converts the high pressure low velocity water in passageway 214 into a high velocity low pressure stream entering into cavity 307. This high velocity stream efficiently entrains air introduced into the cavity 307 via inlet 264. Note also that the orifice 272 is aligned with the hydromassage outlet 304 and passageway 310 to avoid surrendering any energy to turbulence effects. This tub water-air stream of maximized energy then entrains tub water in cavity 314 to increase the mass and momentum of the stream entering the hydromassage passageway entrance 342. As a consequence of the foregoing, a maximum amount of energy is derived from the tap water supplied via water passageway 214 for both rotating member 322, as well as retaining sufficient energy in the stream emanating from discharge orifice 344 to provide a pleasing hydromassage effect while utilizing only 3 gallons or less per minute of supplied tap water.

The air entrained in the water stream discharged from discharge orifice 344 enhances its hydromassage effect, as contrasted with the same water flow without air, by creating small air bubbles. However, the introduction of air cools the water and frequently produces noise which some users may find undesirable. The tub water entrained in the stream discharged from discharge orifice 344 also increases the hydromassage effect of the discharged stream, but without cooling the stream or producing undesirable noise. Various embodiments of the invention disclosed herein enable a user to determine whether he wants to entrain air and/or tub water. In order to entrain tub water, the hand held apparatus must be operated submerged to flood the cavity 314 via passageway 316. If tub water entrainment is not required, embodiments of the invention are intended for out of the water operation.

Whereas it is believed that most users may prefer the hydromassage effect produced by a water stream containing air bubbles, it is recognized that the introduction of air into the water stream tends to cool the water temperature and increase the noise level. Accordingly, the apparatus 200 is configured so that the air supply into the cavity 307 can be readily turned off. Note specifically that by rotating the head housing 204 in a clockwise direction relative to the handle housing 202 from the position depicted in FIG. 5*a*, to the position depicted in FIG. 10, the air inlet 264 will move out of alignment with the exit 224 of air passageway 220 and will be sealed by O-ring 268. This is also depicted in FIG. 8 which makes it clear that the water flow from water passage 214 will pass directly through cavity 307 without air entrainment and thence through passageway 310 into the second cavity 314 where it entrains tub water represented by flow arrows 315.

Figure 8:
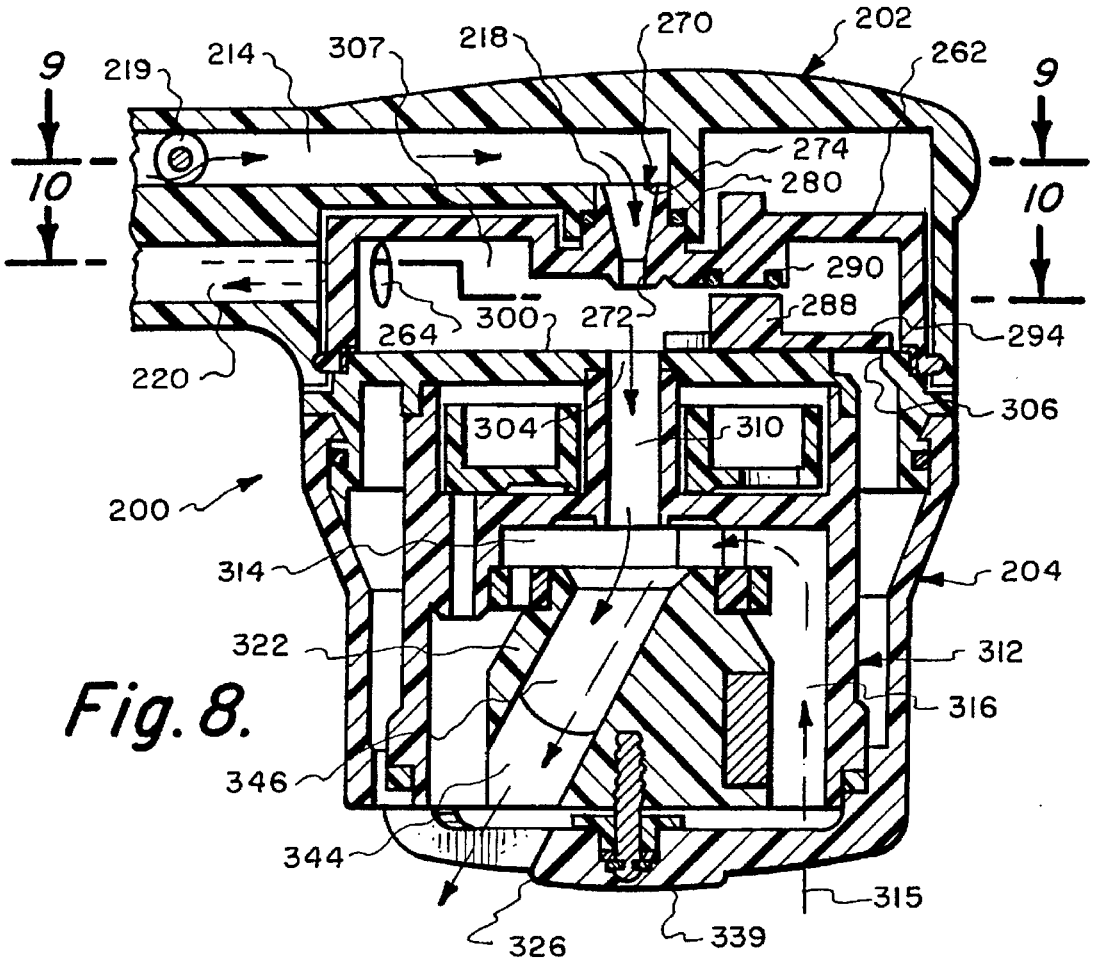
FIG. 8 is a sectional view similar to FIG. 3 except showing the valving set for the hydromassage mode and tub water entrainment but no air entrainment.
Figure 9:
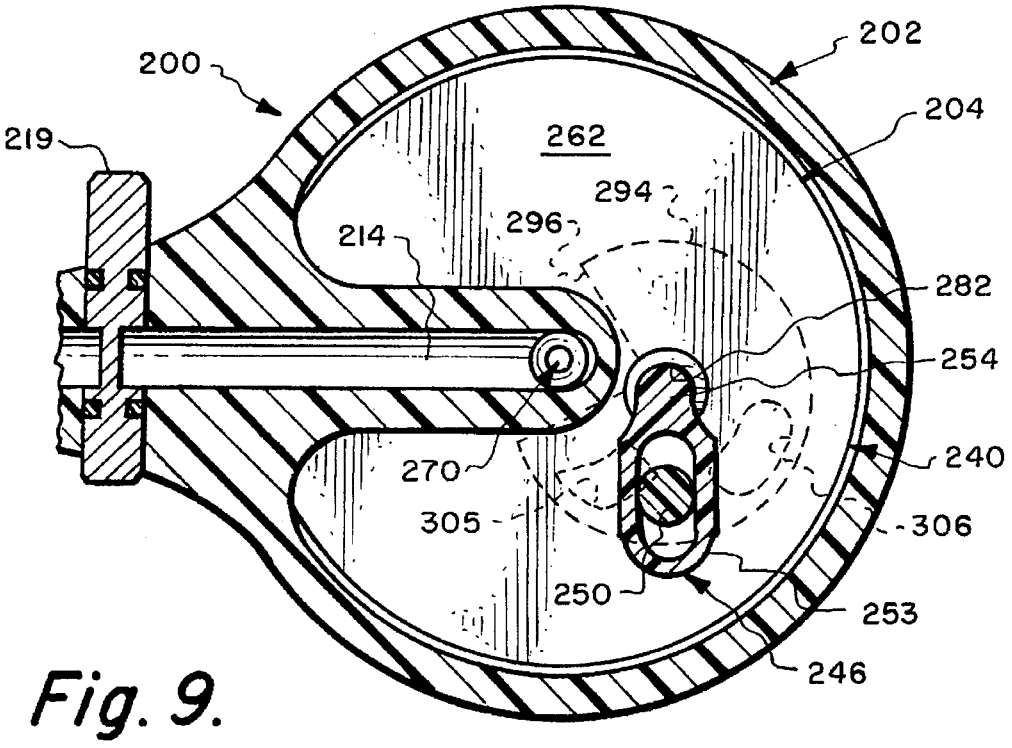
FIG. 9 is a sectional view taken substantially along the plane 9—9 of FIG. 8.
Figure 10:
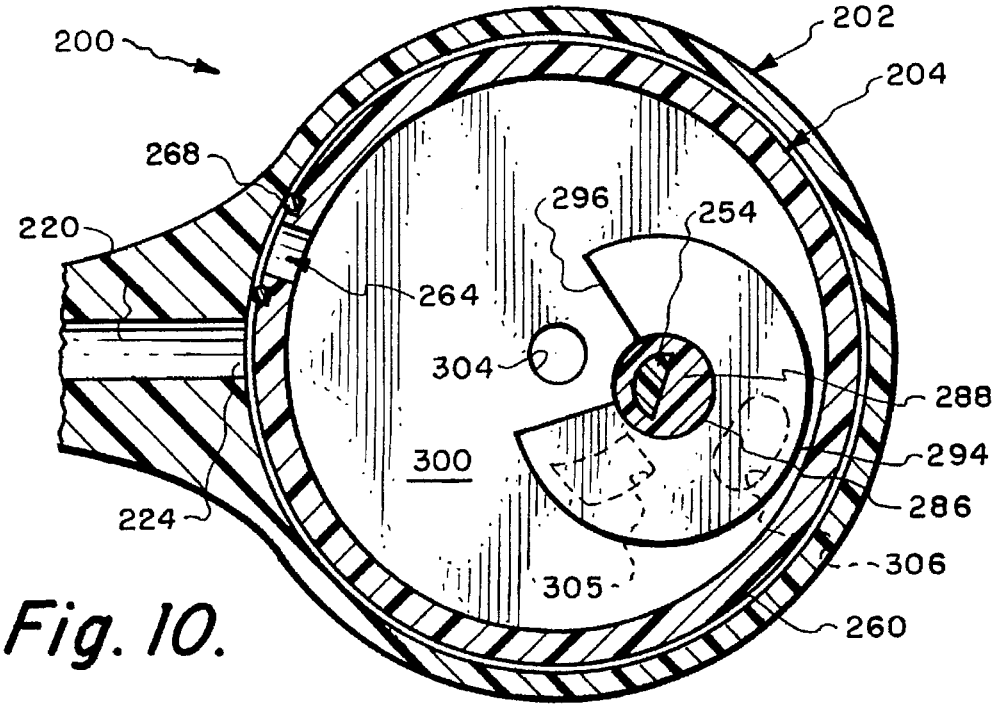
FIG. 10 is a sectional view taken substantially along the plane 10—10 of FIG. 8.

So, the operation of the apparatus 200 in the position represented in FIGS. 8, 9, and 10 is identical to that previously described with respect to FIGS. 2–7 except that no air is introduced into the water stream in cavity 307. Parenthetically, note in FIG. 9 that rotational movement of the head housing 204 relative to the handle housing 202 moved the cover plate 300 defining outlets 304, 305 and 306 relative to the valve element 294 but this movement nevertheless still left outlet 304 within the open sector 296 of valve element 294.

By further rotating the head housing 204 in a clockwise direction relative to the handle housing 202, i.e., from FIG. 10 to FIG. 13, the valve element 294 and outlet plate 262 will move relatively to close hydromassage outlet 304 and open pulsed shower outlet 305. More specifically, as head housing 204 is rotated relative to handle housing 202, the crank shaft 254 turns in opening 282 as pin 250 traverses a circular path around the head housing axis. Thus, pin 250 acts on crank arm 253 to rotate shaft 254 to turn valve element 294. This is the mechanism by which the valve element 294 moves from its position shown in FIG. 5*a* to its position shown in FIG. 10 and then to its position shown in FIG. 13 in which only the pulsed shower outlet 305 is open to cavity 307.

Figure 11:
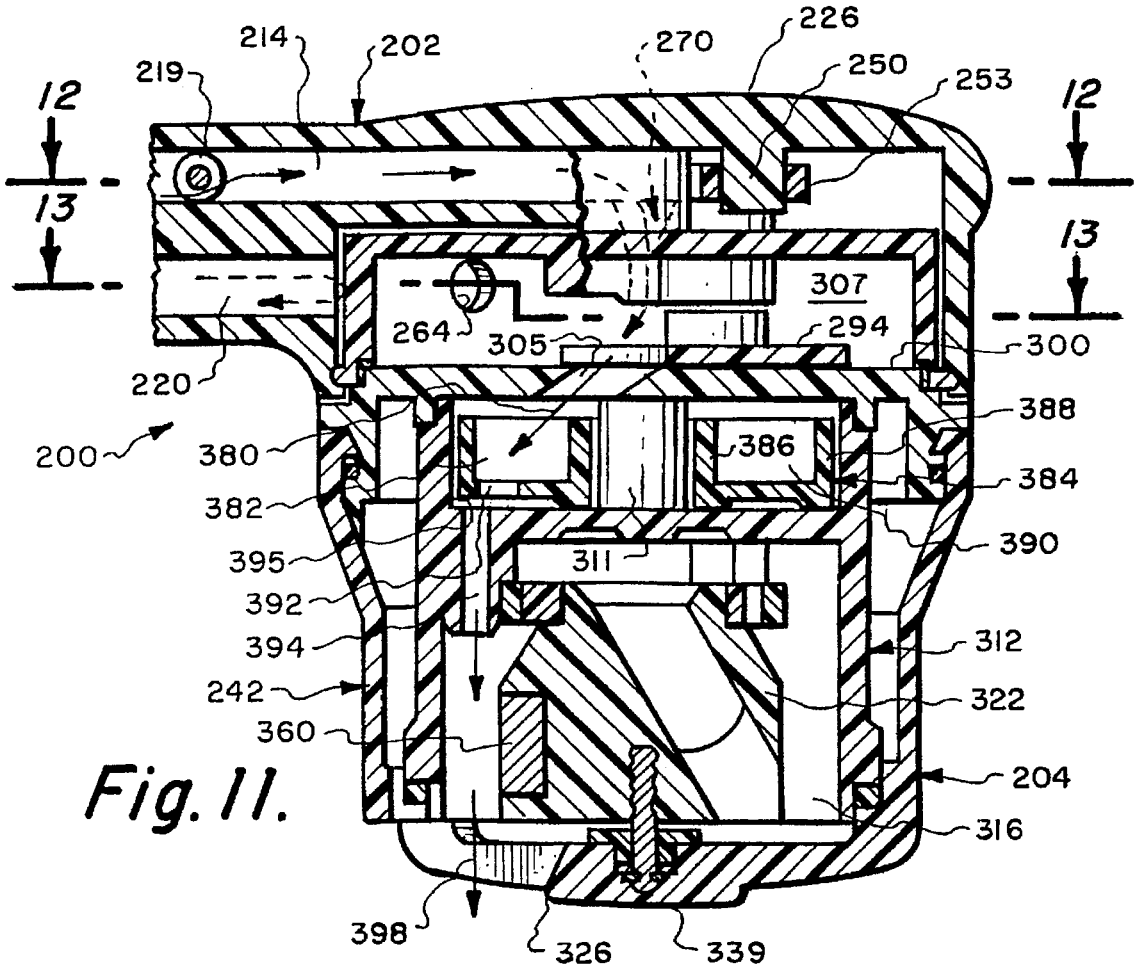
FIG. 11 is a sectional view similar to FIGS. 3 and 8 except showing the valving set for pulse shower mode.
Figure 12:
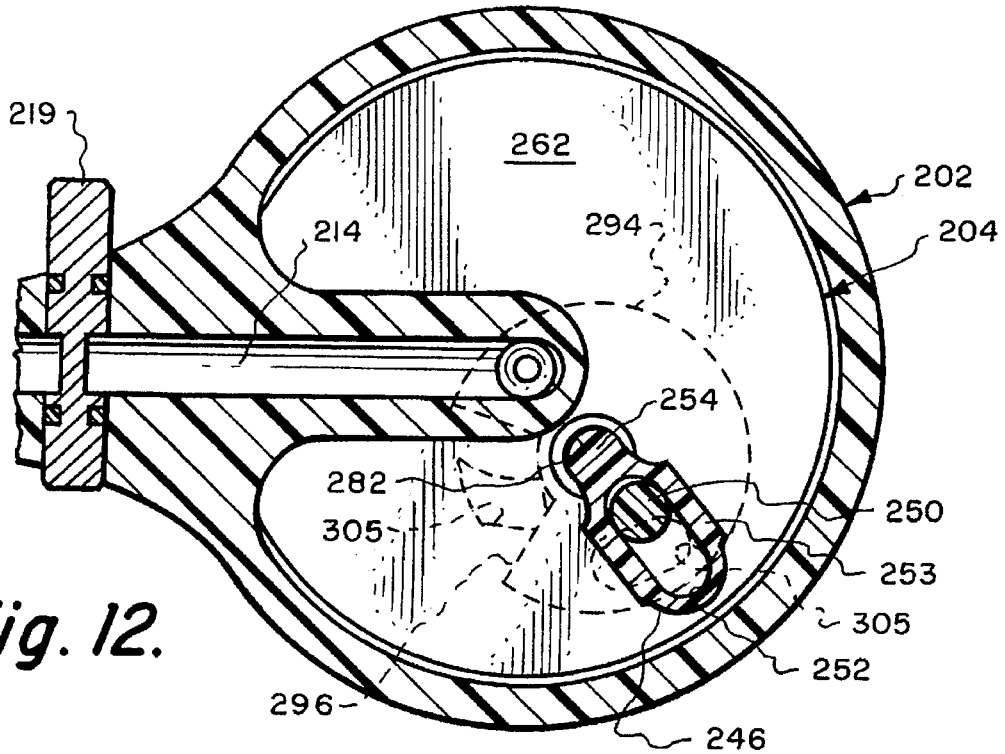
FIG. 12 is a sectional view taken substantially along the plane 12—12 of FIG. 11.

In the position depicted in FIG. 11, the supplied tap water entering cavity 307 via water inlet 270 is directed through pulsed shower outlet 305. Note that outlet 305 is inclined so as to direct the water stream diagonally as represented by arrow 380. The stream thus has a lateral or horizontal component (as viewed in FIG. 11) which impacts against fins 382 of an impeller rotor 384 mounted for rotation around the annular wall 311 projecting axially from the inner cylindrically shaped body 312. The rotor 384 includes inner and outer annular walls 386 and 388 defining a water channel 390 therebetween leading to a plurality of annularly arrayed exit apertures 392. After impacting against the fins moving past the pulsed shower outlet 305 to rotate the rotor 384, the water exits via apertures 392 to shower holes 394. More specifically, a plurality of annularly arranged shower holes 394 are formed beneath the rotor 384. As the rotor 384 rotates, a depending valve element 395 periodically moves into alignment with, and seals, successive shower holes 394 to thus provide a pulsed shower spray represented by flow arrows 398 (FIG. 11) out of the annularly arranged shower holes 394.

Figure 13:
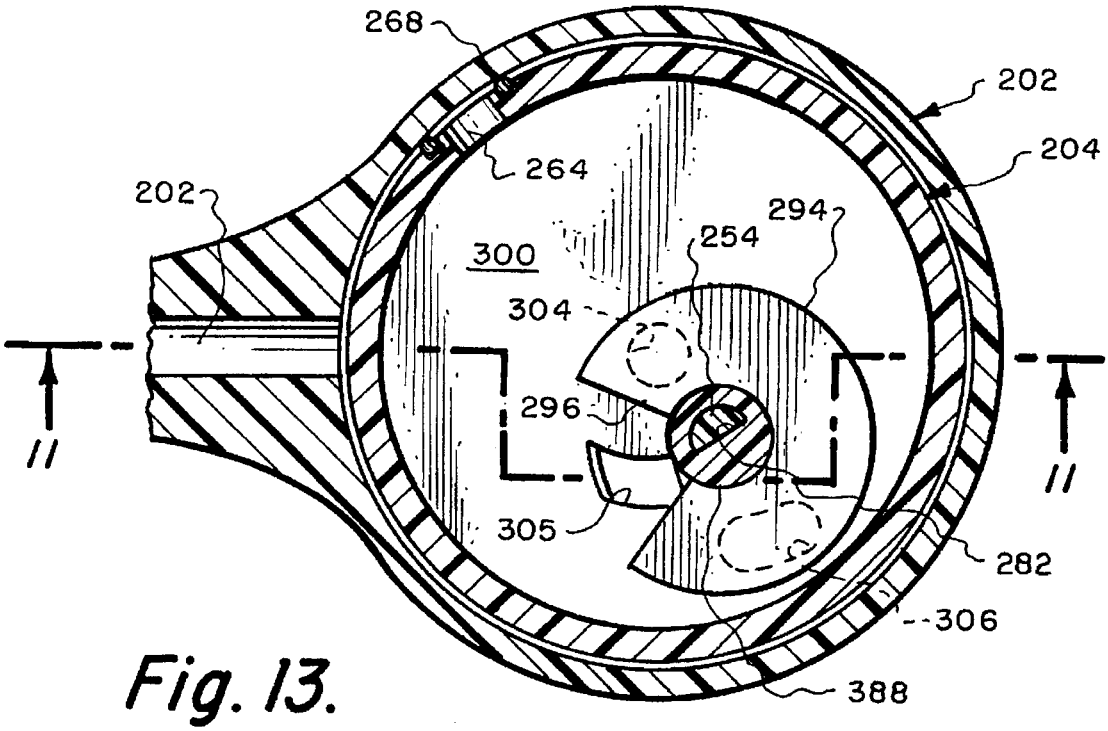
FIG. 13 is a sectional view taken substantially along the plane 13—13 of FIG. 11.
Figure 14:
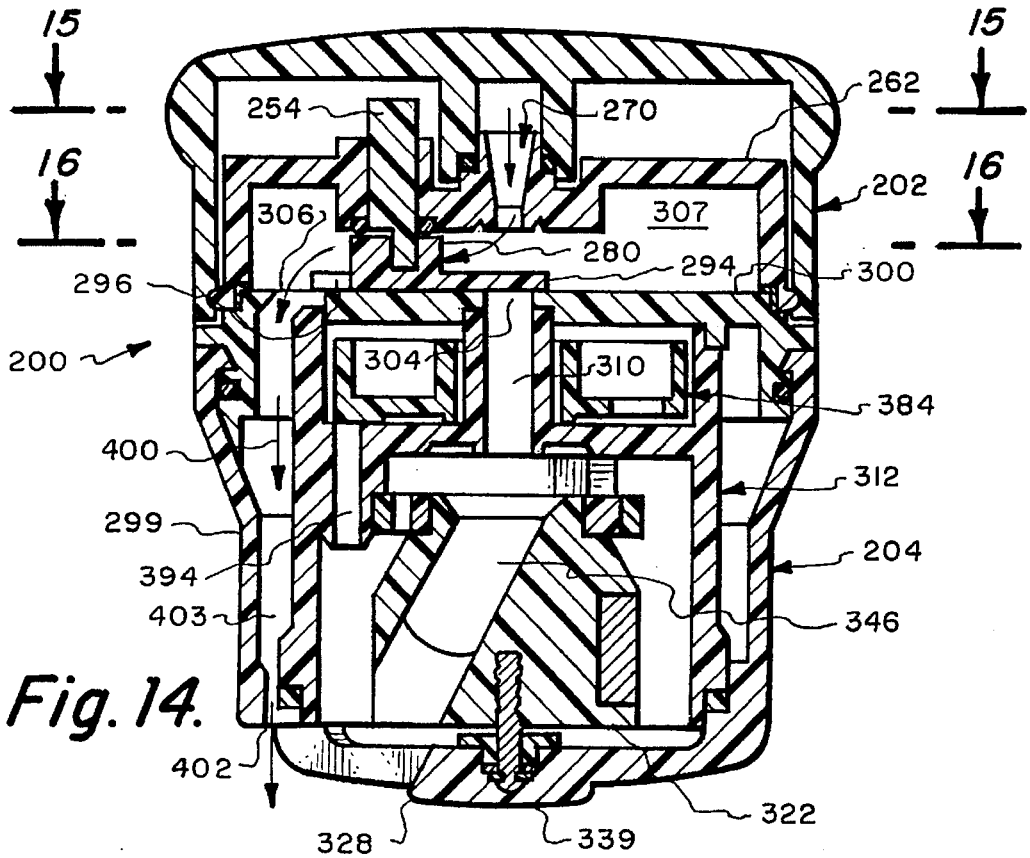
FIG. 14 is a sectional view similar to FIGS. 3, 8, and 11 except showing the valving set for the continuous shower mode.
Figure 15:
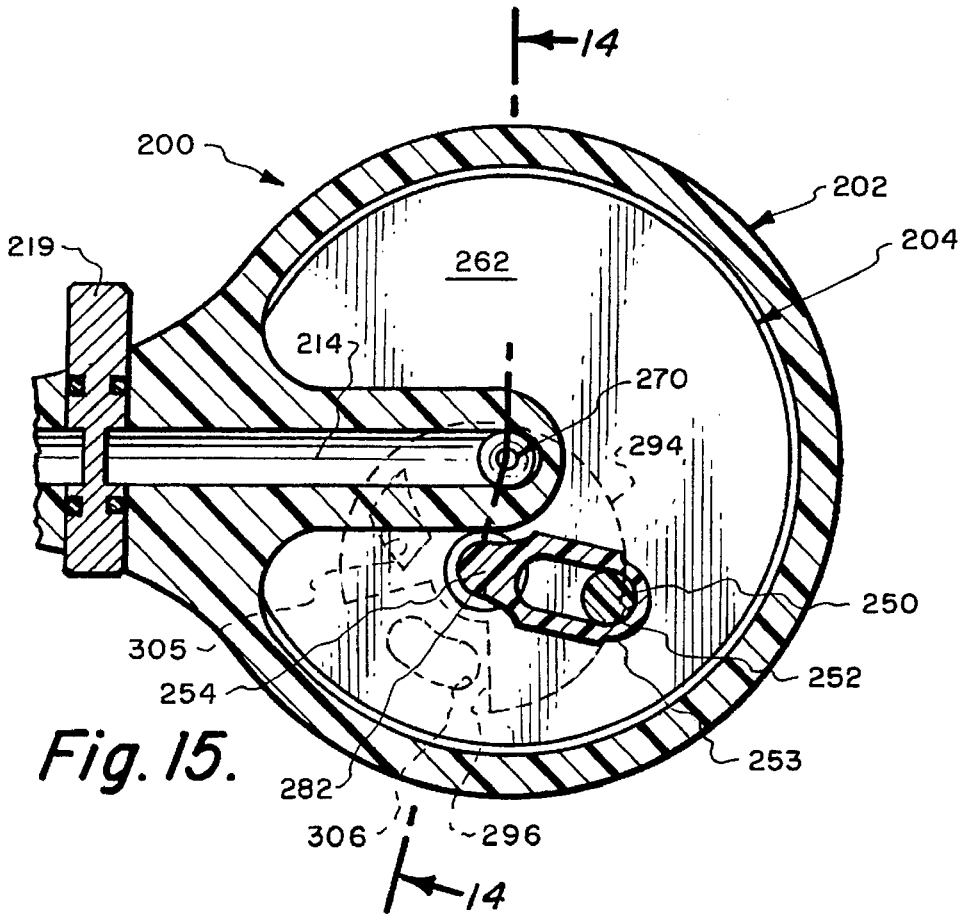
FIG. 15 is a sectional view taken substantially along the plane 15—15 of FIG. 14.
Figure 16:
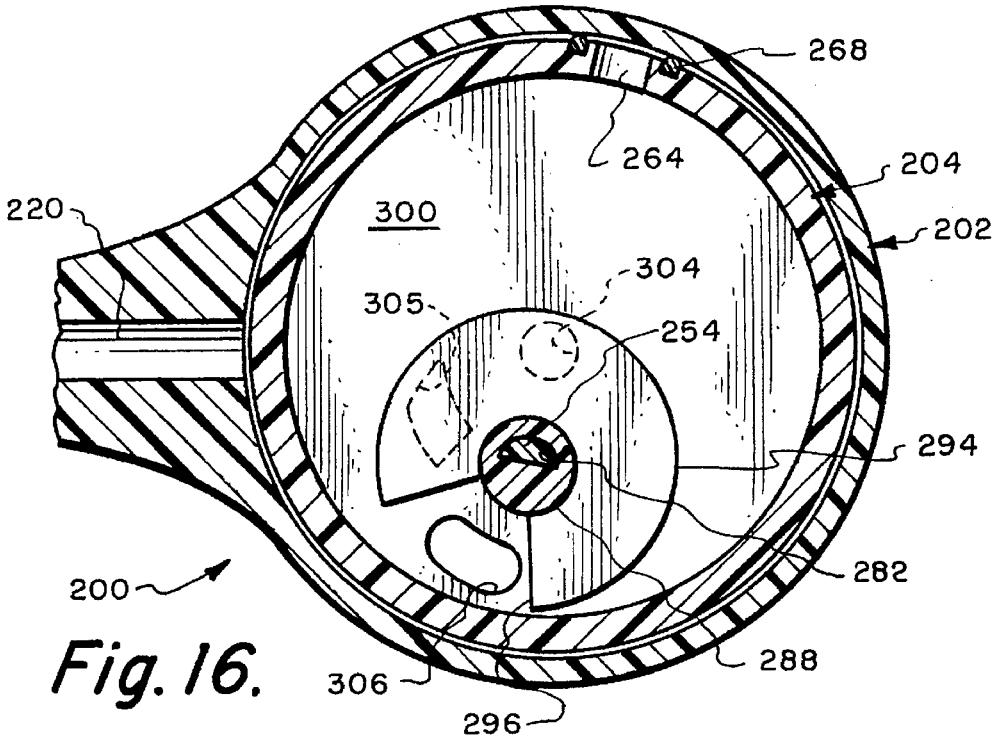
FIG. 16 is a sectional view taken substantially along the plane 16—16 of FIG. 14.

By further rotating the head housing 204 clockwise relative to the handle housing 202, as from the position in FIG. 13 to the position in FIG. 16, the valve element 294 will move to seal the pulsed shower outlet 305 and open the continuous shower outlet 306. With the shower outlet 306 open, the tap water supplied to cavity 307 will be directed, as represented by arrows 400 in FIG. 14, to a plurality of annularly arranged continuous shower holes 402, via manifold 403 defined between cylindrical outer and inner bodies 299, 312. The shower holes 402, preferably defined in an annular ring mounted proximate to the front face of head housing 204, are greater in number and have a smaller cross section than the aforementioned shower holes 394 (FIG. 11) used in the pulsed shower spray mode. The shower holes 402 are annularly arranged, concentrically with but outside of the annular arrangement of pulse shower spray holes 394.

SECOND EMBODIMENT (FIG. 17)

Figure 17:
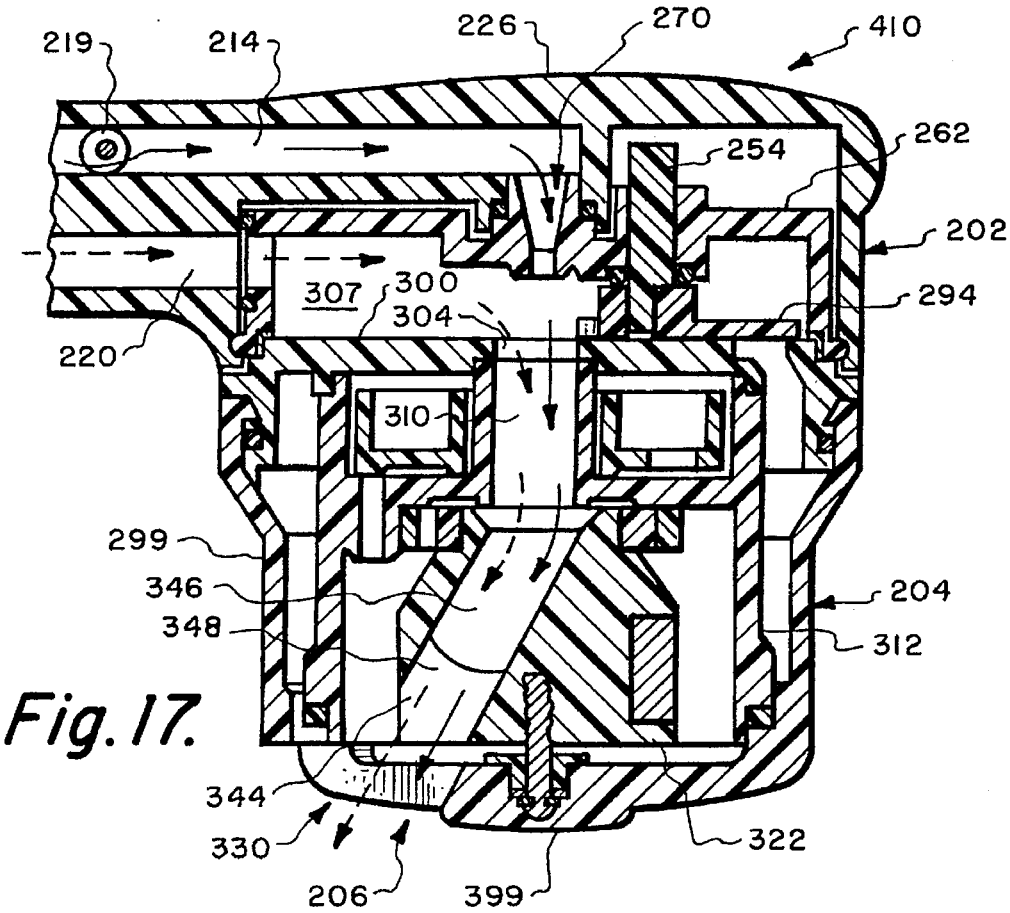
FIG. 17 is a sectional view of a second embodiment of the invention which differs from the embodiment of FIGS. 3–16 in that the second cavity for tub water entrainment is absent.

Attention is now directed to FIG. 17 which illustrates a second embodiment 410 of a hand held apparatus in accordance with the present invention. The embodiment of FIG. 17 is substantially identical to the apparatus 200 of FIGS. 2–16 except that the unit has been made somewhat more compact by eliminating the second tub water entraining cavity 314. As in the embodiment of FIGS. 2–16, the apparatus of FIG. 17 is selectively operable in a hydromassage mode with or without air, a pulsed shower mode, or a continuous shower mode similarly to the apparatus 200 of FIGS. 2–16. However, whereas the apparatus 200 enabled the user to submerge the apparatus to entrain tub water the apparatus 410 of FIG. 17 does not provide this option.

THIRD EMBODIMENT (FIGS. 18, 19)

Figure 18:
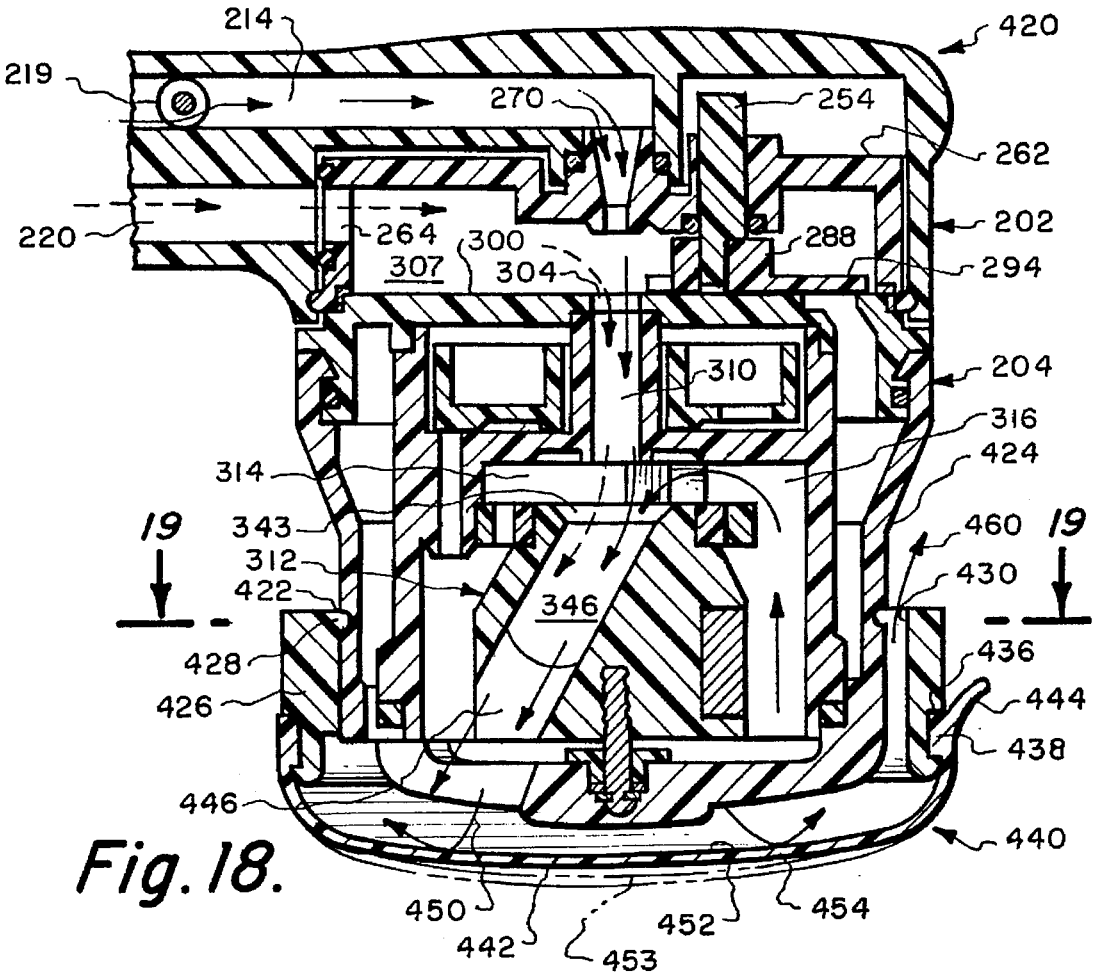
FIG. 18 is a sectional view of a third embodiment, similar to that shown in FIG. 3, except modified to accommodate a flexible membrane mounted proximate to the discharge orifice.

FIG. 18 illustrates a hand held apparatus 420 in accordance with the present invention which is identical to the apparatus 200 depicted in FIG. 3 except that it includes an annular slot 422 in exterior wall surface 424 extending radially inwardly. The function of the slot 422 is to retain a frame 426 whose annular ring 428 fits removably into the slot. A plurality of discharge ports 430 are arranged annularly around the frame 426. The frame 426 in turn defines an annular slot 436 configured to accommodate an annular ring 438 formed on a membrane member 440. The membrane member 440 includes a flexible sheet 442 suspended across the annular ring 438. By proper choice of materials, the membrane 442 and ring 438 can be integrally formed as shown. Preferably, the ring 438 is sufficiently resilient and deformable to enable it to snap into the annular recess 436 formed in frame 426. A finger tab 444 is provided on the annular ring 438 to assist in removing the membrane member 440 from the apparatus 420 for use in the pulsed or continuous shower spray modes.

Figure 19:
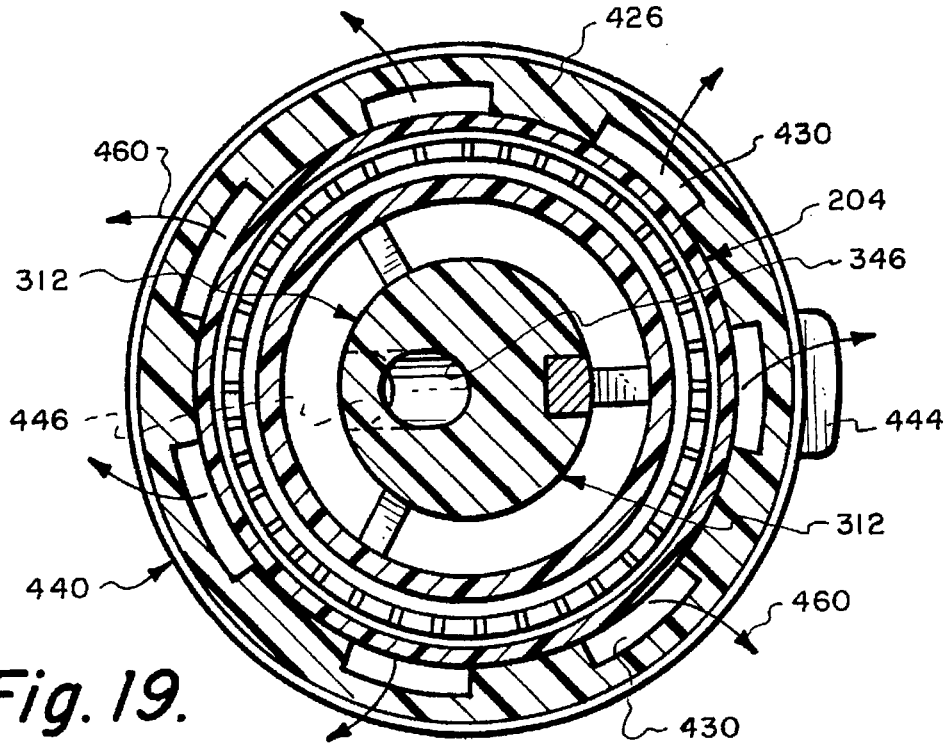
FIG. 19 is a sectional view taken substantially along the plane 19—19 of FIG. 18.

Note that with the membrane member 440 installed as shown in FIG. 18, the flexible membrane 442 extends across the front face of the hand held apparatus 420. Thus, as the discharge orifice 446 moves along its circular travel path in the hydromassage mode, it will discharge its hydromassage stream 450 against the rear face 452 of the membrane 442 locally stretching the membrane to its dashed line position 453. Inasmuch as the membrane 442 is flexible and thin, the user can hold the front face 454 of the membrane against his/her body, enabling the massaging effect of the hydromassage stream to be felt through the membrane 442 without the water stream directly contacting the user. Rather, as is depicted in FIGS. 18 and 19, the discharged water stream 450 after impacting against the rear membrane face 452 will be directed rearwardly through the aforementioned discharge ports 430 as represented by flow arrows 460 in FIGS. 18 and 19. By providing this flow path through discharge ports 430, the presence of the membrane will not interfere with the flow from the discharge orifice 446. The apparatus 420 functions in the hydromassage mode both submerged and out of the water.

FOURTH EMBODIMENT (FIGS. 20–23)

Attention is now directed to FIGS. 20–23 which illustrate a fourth embodiment 460 of hand held apparatus in accordance with the present invention, which is substantially identical to the embodiment 200 FIGS. 2–16 except for the mechanism for controlling the valve element 294 (FIG. 7). More particularly, in lieu of the pin 250 depending from the cover plate 226 in FIG. 7, the embodiment of FIGS. 20–23 includes an arcuate rack 464 defining internal gear teeth 466. The rack 464 is fixed to the plate 468 of handle housing 470.

Figure 20:
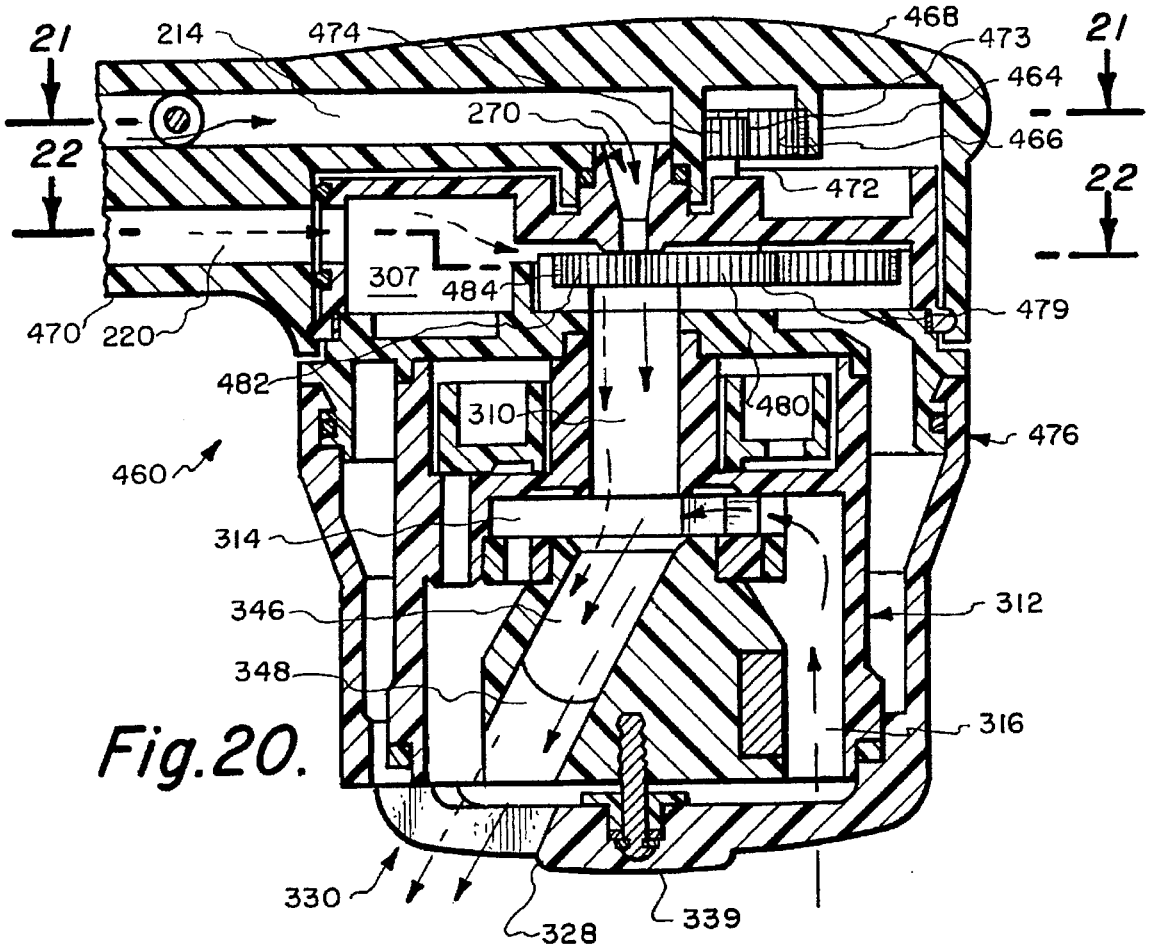
FIG. 20 is a sectional view of a fourth embodiment of the invention differing from FIG. 3 primarily in that it incorporates a gear driven mechanism for valve control.
Figure 21:
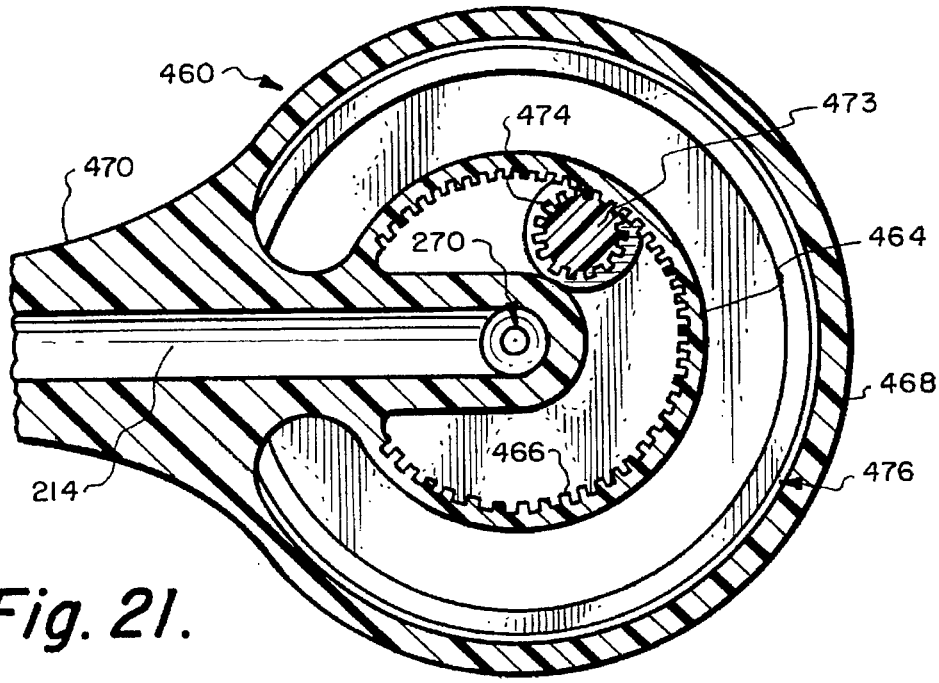
FIG. 21 is a sectional view taken substantially along the plane 21—21 of FIG. 20.
Figure 22:
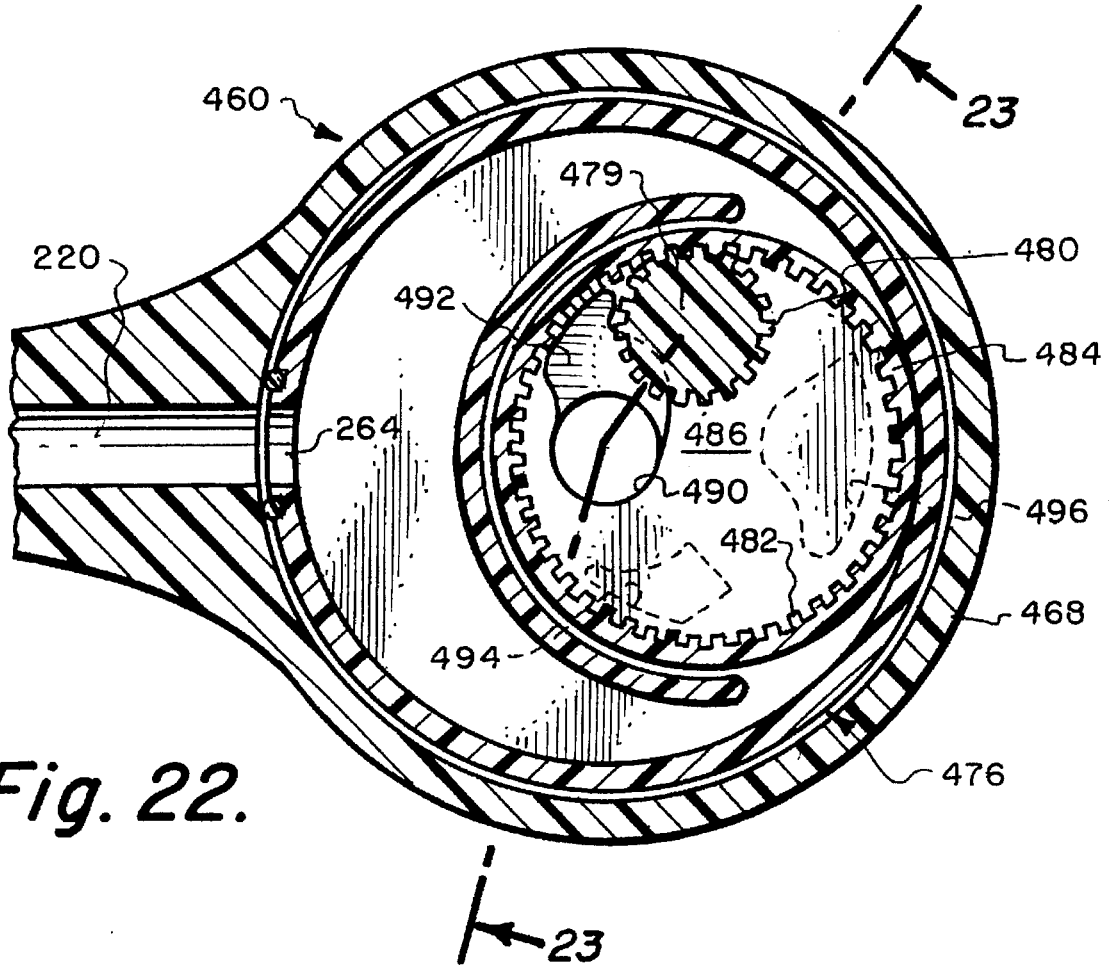
FIG. 22 is a sectional view taken substantially along the plane 22—22 of FIG. 20.
Figure 23:
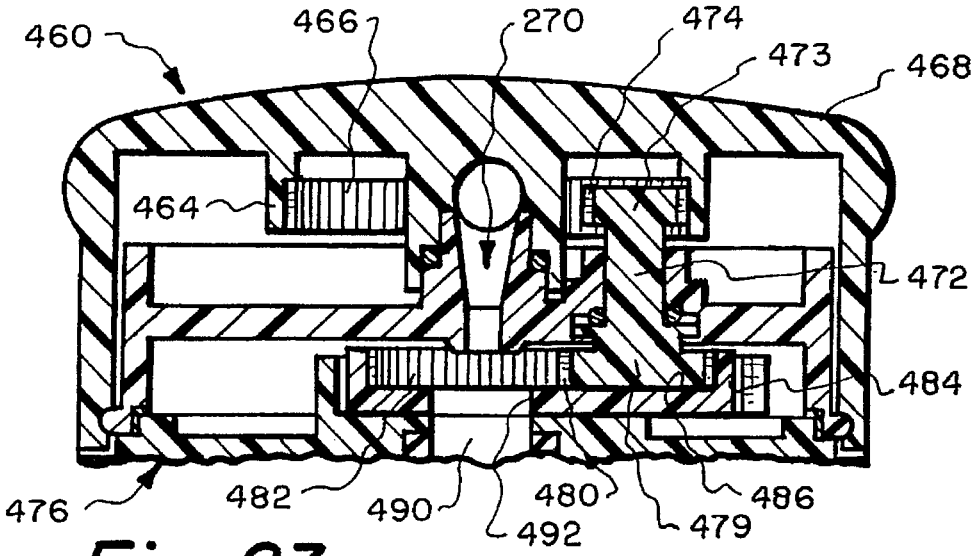
FIG. 23 is a sectional view taken substantially along the plane 23—23 of FIG. 22.
Figure 24:
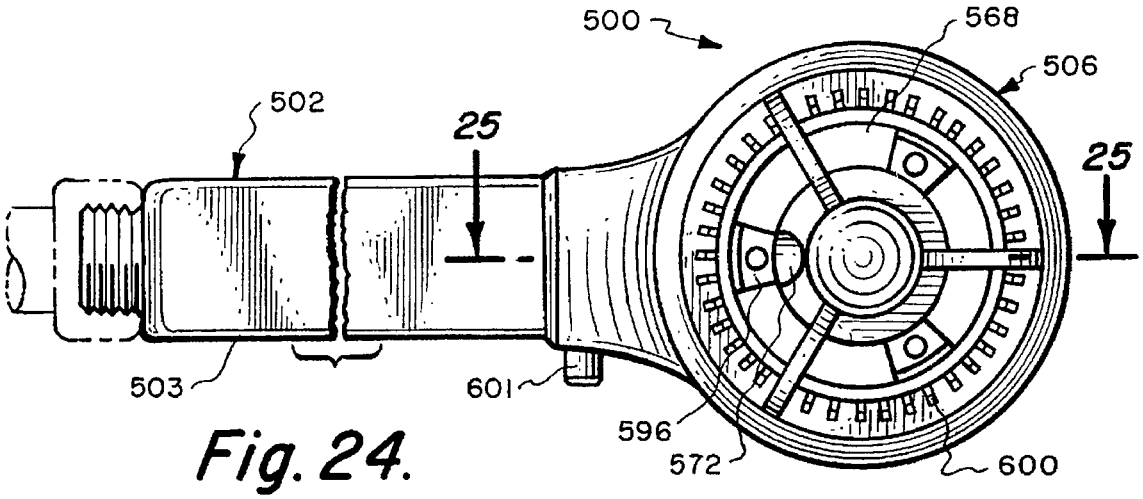
FIG. 24 is a bottom plan view of the housing of a fifth embodiment of the invention which differs from the embodiment depicted in FIG. 2 primarily in that the means for entraining air has been deleted.

A short vertical shaft 472 has an upper gear 473 having external teeth 474 engaged with the teeth of rack 464. The shaft 472 is mounted on the head housing 476. As the head housing 476 is moved rotationally about its axis with respect to the handle housing 470, the shaft 472 will move along the rack 464 and in so doing, the shaft 472 will rotate about its axis as a consequence of the geared engagement between teeth 466 and teeth 474. Whereas the gear 473 is mounted at the upper end of shaft 472, as depicted in FIG. 20, the lower end of shaft 472 includes a similar gear 479 having external teeth 480. These external teeth 480 are engaged with annularly arranged internal teeth 482 formed on an annular ring 484 affixed to a valve disk element 486. Valve disk element 486 includes a port 490, which is analogous to the open sector 296 of valve element 294 in FIG. 7. The disk valve element 486 overlays hydromassage outlet 492, pulsed shower outlet 494, and continuous shower outlet 496. The apparatus of FIGS. 20–23 is operated by the user in the same manner as the apparatus of FIGS. 2–16. That is, by rotating the handle housing 470 relative to the head housing 476, the port 490 in valve element 486 can be selectively moved to define either the hydromassage mode, the pulsed shower mode, or the continuous shower mode. In the hydromassage mode, the user can choose to entrain both air and tub water or tub water alone.

FIFTH EMBODIMENT (FIGS. 24–31)

The hand held apparatus 500 in accordance with the invention depicted in FIGS. 24–31 is physically more compact than the units previously described. The reduction in size is partially attributable to the elimination of both an air supply passageway entrainment cavity. Additionally, compactness is achieved by a more direct arrangement of the selector valve mechanism for establishing the operating mode.

Figure 25:
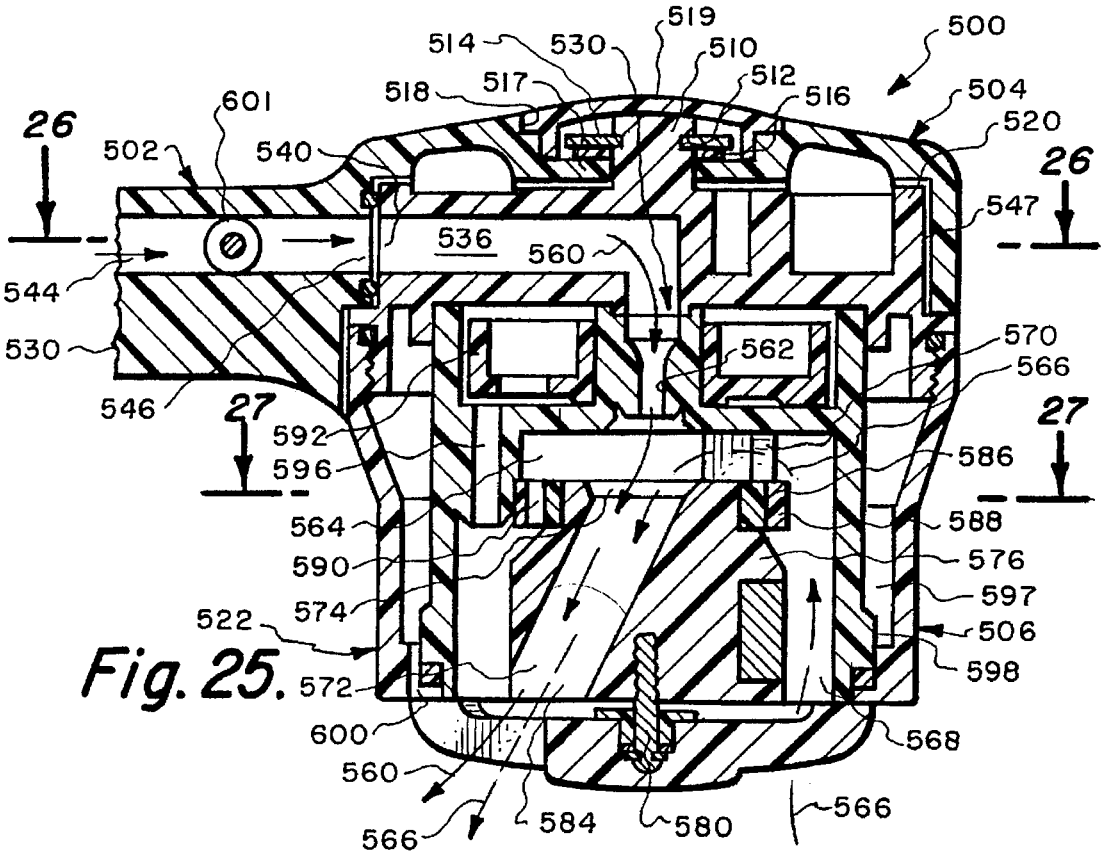
FIG. 25 is a sectional view taken substantially along the plane 25—25 of FIG. 24 showing the internal structure of the apparatus with the valving set for hydromassage mode.

More particularly, note in FIG. 25 that a handle housing 502 is provided having an elongate handle portion 503 and a substantially cylindrical interface portion 504. The apparatus 500 further includes a headhousing 506 which is substantially cylindrically shaped and includes an upwardly extending central boss 510. The boss 510 defines an annular slot 512 which receives spring clip 514. Clip 514 rests on a washer 516 supported on inwardly projecting flange 517, comprising part of the handle housing 502, extending into recess 518. Note that the boss 510 is thus supported from the handle housing and is rotatable with respect thereto about its central axis. Removable cap 519 covers recess 518.

The boss 510 forms part of an inlet member 520 comprising the upper portion of the head housing 506. A discharge member 522, comprising the lower portion of the head housing, is fixed to the inlet member 520, as by gluing.

Figure 26:
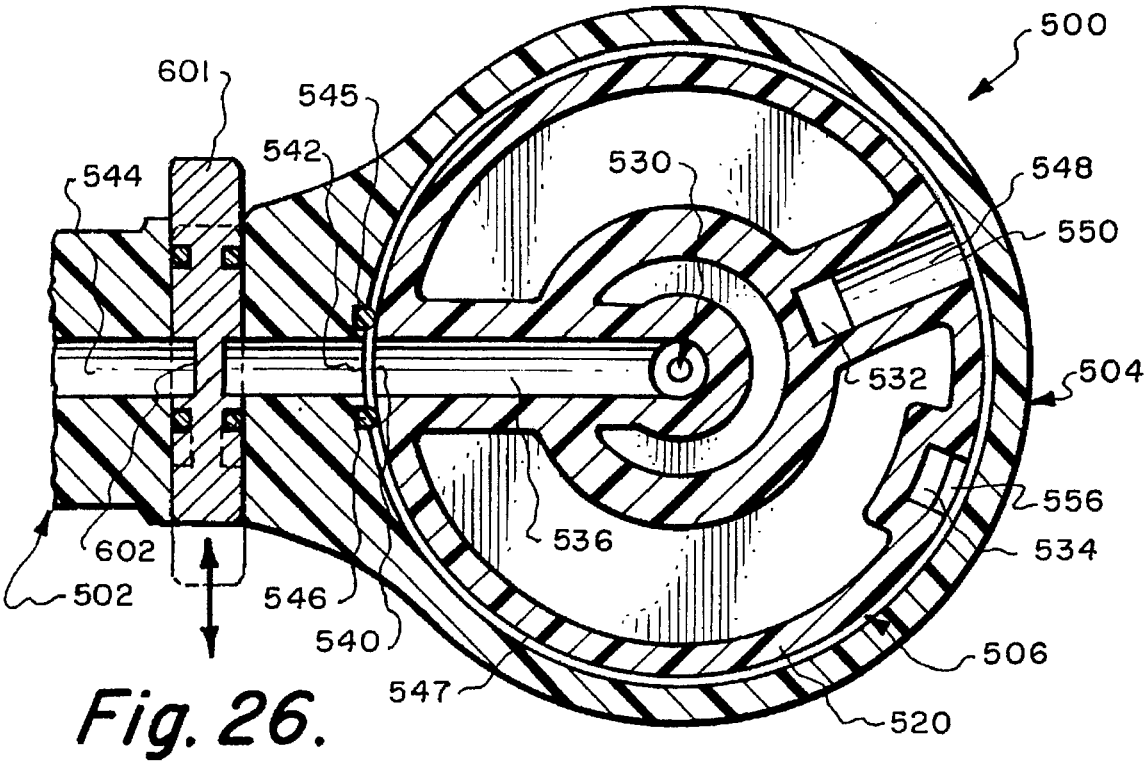
FIG. 26 is a sectional view taken substantially along the plane 26—26 of FIG. 25.

With reference to FIG. 26 note that the inlet member 520 defines a central hydromassage outlet 530, a pulsed shower outlet 532, and a continuous shower outlet 534. Associated with the hydromassage outlet 530 is an internal passage 536 extending through inlet member 520 to a hydromassage inlet 540. FIG. 26 shows the hydromassage water inlet 540 in alignment with the exit 542 of water supply passageway 544 extending through the handle housing 502. An O-ring 545 is mounted in recess 546 to prevent leakage from exit 542 into the space 547 between the outer surface of inlet member 520 and the inner surface of interface portion 504.

Note also that pulsed shower outlet 532 in inlet member 520 is coupled to a passageway 548 (FIG. 28) defining an open inlet at 550 which can be selectively aligned with the water supply exit 542 by appropriately rotating the inlet member 520 relative to the handle housing 502. Similarly, the continuous shower spray inlet 534 is associated with a short passageway 556 (FIG. 30) which likewise can be selectively rotated into alignment with the water supply exit 542.

FIGS. 25 and 26 depict the inlet member 520 rotated to a position where the hydromassage passageway 536 is aligned with the water supply exit 542. As a consequence, the tap water 560 will flow from passageway 536 through hydromassage outlet 530 and then through restricted cross section orifice 562 into tub water entrainment cavity 564. Note, that as the tap water enters the cavity 564 at a high velocity attributable to the restricted cross section orifice 562, it will entrain tub water 566 pulled into cavity 564 via passageway 568 and cavity opening 570. The combined tap water-tub water flow then enters hydromassage passageway 572 via entrance 574. The passageway 572 is formed in a cylindrical member 576, essentially identical to the previously discussed member 322 (FIG. 3), mounted for rotation about axial pin 580. The tap water-tub water flow emerges from the passageway discharge orifice 584, which, as should be recognized from the prior discussion will move along a circular travel path whose axis is defined by pin 580.

Figure 27:
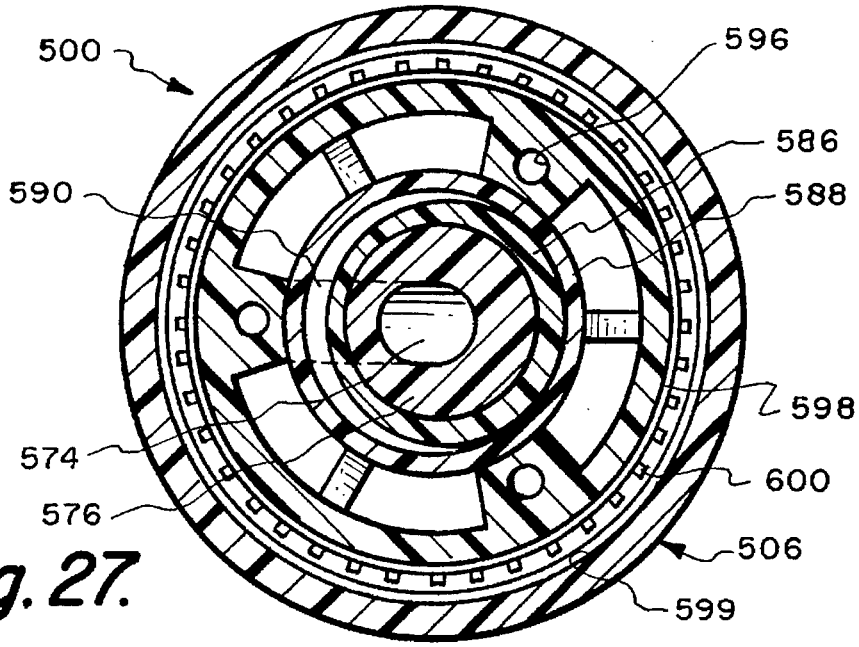
FIG. 27 is a sectional view taken substantially along the plane 27—27 of FIG. 25.
Figure 28:
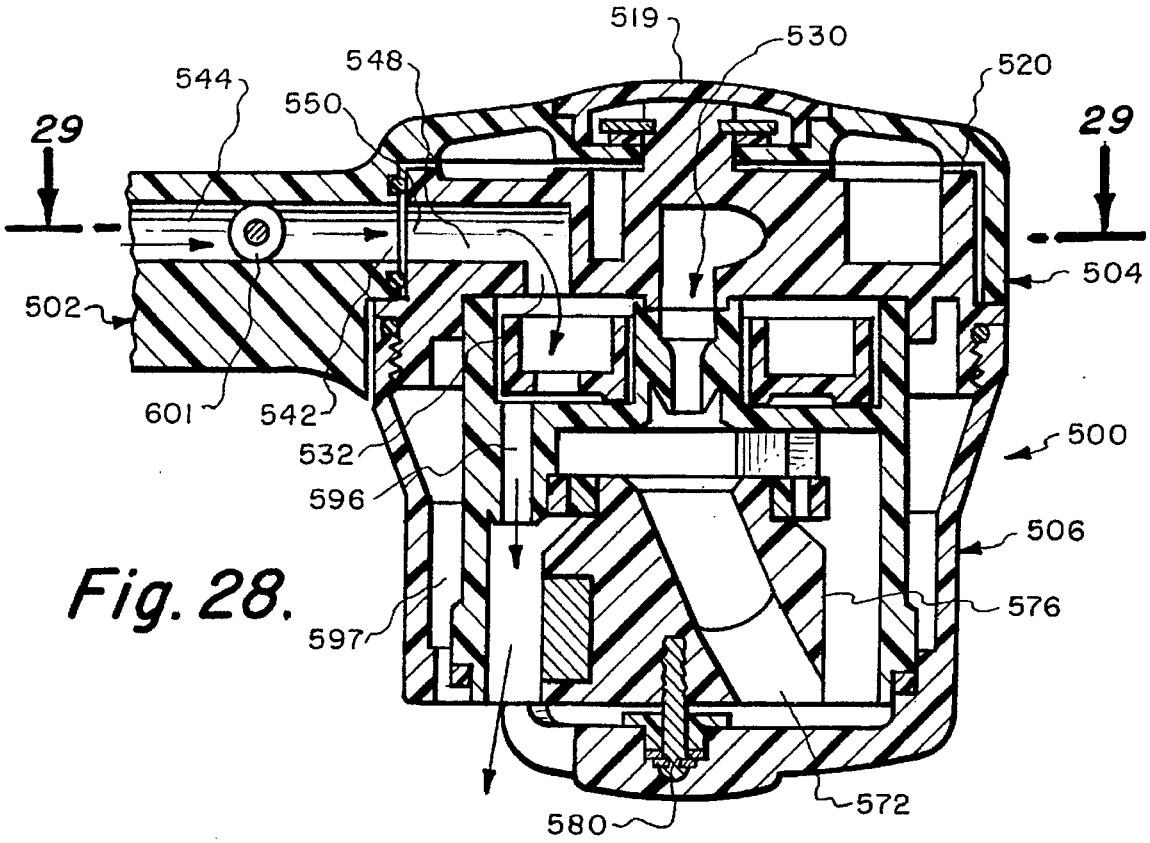
FIG. 28 is sectional view similar to FIG. 25 except showing the valving set for pulse shower mode.
Figure 29:
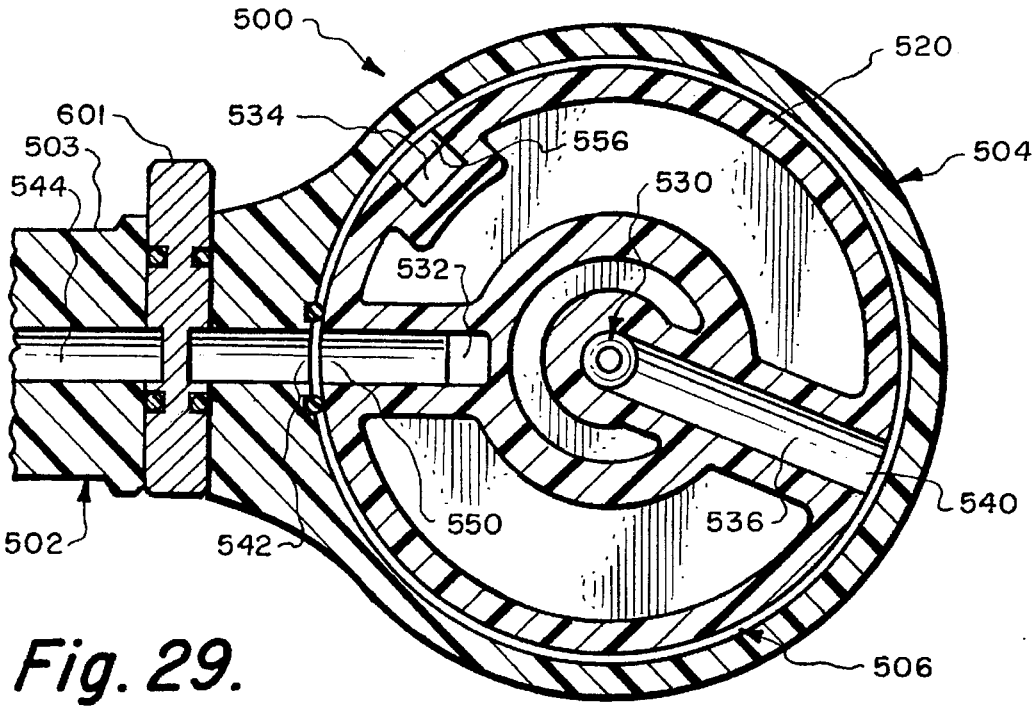
FIG. 29 is a sectional view taken substantially along the plane 29—29 of FIG. 28.
Figure 30:
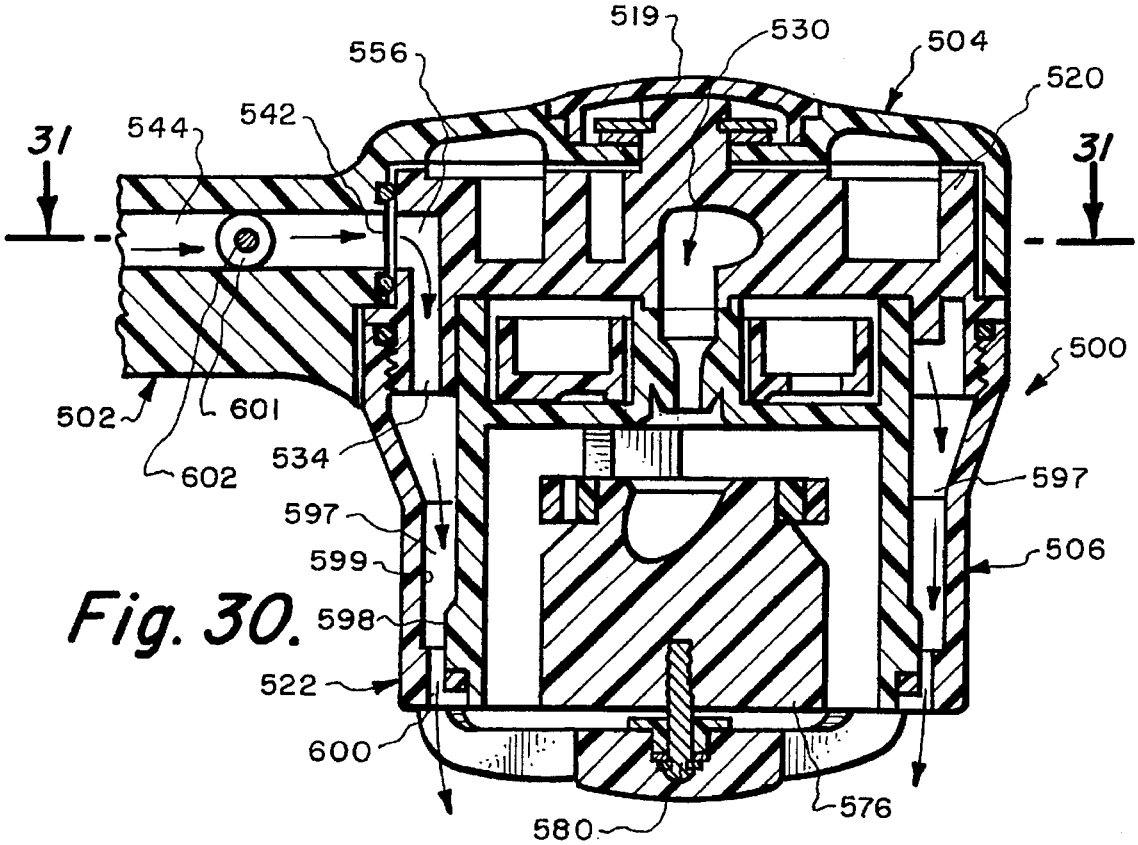
FIG. 30 is a sectional view similar to FIGS. 25 and 27 except showing the valving set for continuous shower mode.
Figure 31:
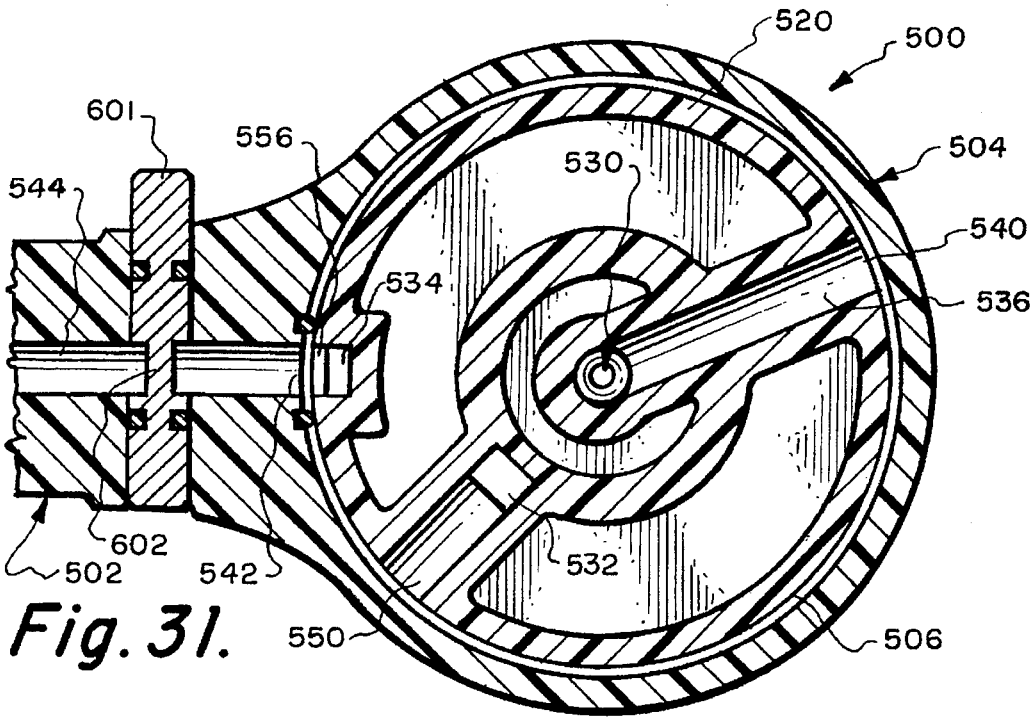
FIG. 31 is a sectional view taken substantially along the plane 31—31 of FIG. 30.

FIG. 27 is substantially identical to FIG. **5*b* and illustrates the member 576 showing the passageway 574 and the eccentrically configured bearing ring 586 mounted on member 576 for rotation within outer bearing ring 588. Note in FIG. 27 that the bearing rings 586 and 588 are engaged at the high point of ring 586 toward the right side of the figure, i.e., at a three o'clock position. This high point is located essentially opposite to the direction of lateral thrust produced by the stream emanating from the discharge orifice 584. This positioning of the inner bearing ring 586 forms the gap 590 between the bearing rings which permits a small amount of tub water to be pulled into the cavity 564** between the bearing rings to lubricate the bearing ring surfaces.

When the head housing 506 is rotated relative to the handle housing to move inlet 550 (FIG. 28) into alignment with the water supply exit 542, tap water will flow into impeller rotor 592, substantially identical to the impeller rotor described in connection with the embodiment of FIGS. 2–16. As the rotor 592 rotates, it will periodically discharge the tap water supplied thereto through a plurality of annularly arranged pulsed shower holes 596.

By further rotating the head housing 506 relative to the handle housing 502, the inlet 556 can be brought into alignment with the water supply exit 542 (FIG. 30) thereby supplying tap water to manifold 597 between inner and outer cylindrical members 598, 599 of the discharge member 522, comprising the lower portion of head housing 506. The manifold 597 is coupled to a plurality of annularly arranged continuous shower holes 600.

It should also be noted that the embodiment 500, similar to the aforedescribed embodiment, includes a manually operable water control slide valve 601 mounted in the handle housing 502. Note that the slide valve 601 includes a centrally located reduced cross section portion 602. When the portion 602 is aligned with the water supply passageway 544 in the handle housing 502, tap water can of course flow therepast to the water supply exit 542. By sliding the valve 600 from its solid line position shown in FIG. 26 to its dashed line position, the full diameter portion of the valve 601 will move into alignment with the passageway 544 thereby essentially stopping the flow of supplied tap water to the exit 542. As should be apparent, the slide valve 600 can be incrementally moved between its extreme positions to enable a user to vary the flow of tap water supplied to the exit 542.

SIXTH EMBODIMENT (FIG. 32)

Figure 32:
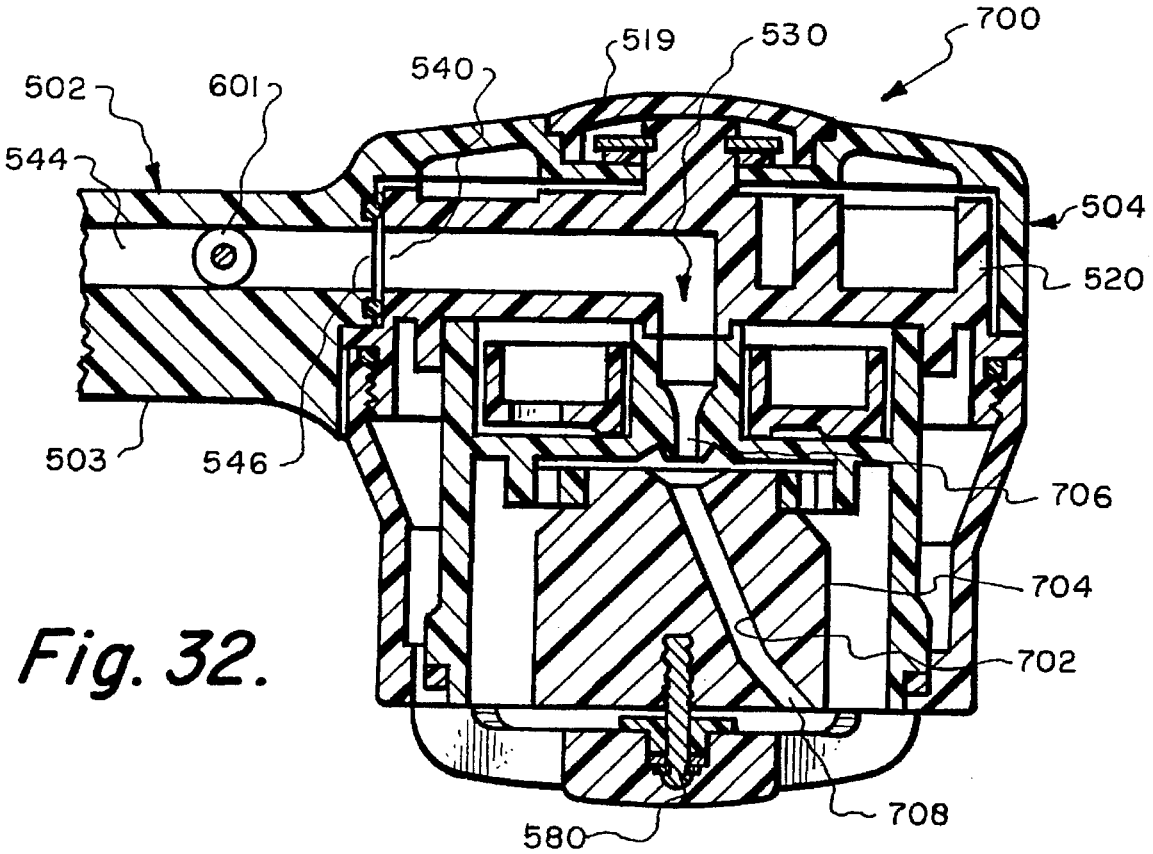
FIG. 32 is sectional view of a sixth embodiment of the invention which is selectively operable in either a continuous or pulse shower spray mode or hydromassage mode, but which does not provide for either air or tub water entrainment.

Attention is now directed to FIG. 32 which illustrates a further apparatus 700 in accordance with the present invention. The apparatus 700 is similar to the apparatus 500 depicted in FIGS. 24–31 except that it can be made even more compact as a consequence of eliminating the water entrainment cavity 564. Note that whereas the hydromassage passageway 572 in the rotating member 576 in FIG. 25 had a cross section larger than that of the cross section orifice of restricted 562 in order to accommodate the entrained tub water (or entrained air in other embodiments), the hydromassage passageway 702 in rotating member 704 in FIG. 32 is dimensioned substantially the same as the restricted cross section orifice 706, i.e., ≦3/16 inch, to maintain water usage at ≦3 gallons per minute. Although the water stream discharged from the discharge orifice 708 as it moves along its circular travel path, will have a lower mass than the water streams discharged in the prior embodiments inasmuch as it contains no entrained component, its velocity will be greater because of the reduced dimension of its hydromassage passageway 702 as compared with the passageways of the aforedescribed embodiments. This will yield a more intense and focused discharge stream, producing a massaging effect different from that provided by the aforementioned embodiment. In other respects, the embodiment of FIG. 32 is analogous to the embodiment of FIGS. 24–31.

From the foregoing, it should now be recognized that a plurality of hand held water discharge devices have been disclosed herein configured for operating with a relatively low flow rate (≦3.0 g.p.m.) tap water supply (≧20 p.s.i) for producing a pleasing hydromassage effect, supplemented by a mechanical massaging effect produced by holding a protuberance mounted at the front face of the apparatus, against a user's body. The energy in the supplied tap water is efficiently utilized, via a restricted cross section orifice, to discharge a pleasing hydromassage stream, with or without entrained air and/or tub water, from a discharge orifice which is driven along a circular travel path. A mode selector valve incorporated in each described embodiment enables a user to select between a hydromassage mode, a pulsed shower spray mode, or a continuous shower spray mode, although, of course, alternative embodiments of the invention need not provide for all modes of operation.

Although specific embodiments of the invention are disclosed herein, it is recognized that various structural modifications and equivalents may occur to those skilled in the art and it is accordingly intended that such be included within the scope of the appended claims.

We claim:

1. Apparatus for use with a tap water source supplying pressurized water for selectively discharging a hydromassage stream or a shower water spray, said apparatus comprising:

a housing configured to be held in a user's hand, said housing defining an internal cavity having a water inlet, an air inlet, a hydromassage outlet, and a shower outlet;

an air supply passageway in said housing having (1) an externally accessible air supply entrance and (2) an air supply exit means communicating with said cavity air inlet for supplying air to said cavity;

a water supply passageway in said housing having (1) an externally accessible water supply entrance and (2) a water supply exit means communicating with said cavity water inlet for introducing a tap water flow of sufficient velocity into said cavity to entrain air supplied thereto; and user operable outlet valve means in said housing located downstream from said cavity inlets for selectively directing a water stream from said cavity through either said hydromassage outlet or said shower outlet; and, means for blocking water outflow through said air inlet when said outlet valve means directs said water stream through said shower outlet.

2. The apparatus of claim 1 including means aligning said water supply exit means and said cavity water inlet, and including restricted cross-section orifice means for increasing the velocity of tap water flow into said cavity.

3. The apparatus of claim 1 further including means defining a hydromassage passageway having an entrance orifice communicating with said hydromassage outlet and a discharge orifice for discharging said hydromassage stream.

4. The apparatus of claim 3 further including means supporting said discharge orifice for movement along a travel path in response to said hydromassage stream being discharged therefrom.

5. The apparatus of claim 4 further including a membrane having front and rear faces; and means mounting said membrane on said housing with said rear face proximate to said discharge orifice travel path for enabling said hydromassage stream to impact against said rear face without restricting the outflow from said discharge orifice.

6. The apparatus of claim 5 wherein said membrane mounting means is configured to readily permit manual removal of said membrane from said housing.

7. The apparatus of claim 1 wherein said housing includes a second internal cavity having a primary water in-port, a secondary water in-port and a water out-port;

means communicating with said secondary water in-port externally of said housing for supplying tub water to said second cavity;

means communicating said primary water in-port with said hydromassage outlet for introducing a tap water flow of sufficient velocity into said second cavity to entrain tub water supplied thereto;

a member defining a hydromassage passageway having an entrance orifice and a discharge orifice; and means communicating said water out-port with said hydromassage passageway entrance orifice.

8. The apparatus of claim 1 wherein said housing defines a plurality of spaced externally opening shower holes; and shower passageway means communicating said shower outlet with said shower holes.

9. The apparatus of claim 8 further including pulse means mounted downstream from said shower outlet for periodically interrupting the water stream to said shower holes.

10. The apparatus of claim 1 further including a member defining a hydromassage passageway having an entrance orifice and a discharge orifice;

means mounting said member with said entrance orifice communicating with said hydromassage outlet for discharging a hydromassage stream from said discharge orifice;

said mounting means including means supporting said member for movement of said discharge orifice along a travel path in response to said hydromassage stream being discharged therefrom; and protuberance means mounted on said housing proximate to said discharge orifice travel path for engaging and massaging a user's body.

11. The apparatus of claim 10 further including weight means eccentrically carried by said member for enhancing the massaging of said user's body by said protuberance means.

12. Apparatus for use with a water tub having a tap water source supplying pressurized water for selectively discharging a hydromassage stream or a shower water spray, said apparatus comprising:

a housing configured to be held in a user's hand, said housing defining an internal cavity having a supply water inlet, a tub water inlet, and a hydromassage outlet;

a tub water passageway in said housing having (1) an externally accessible tub water supply entrance and (2) a tub water supply exit means communicating with said cavity tub water inlet for supplying tub water thereto;

a tap water supply passageway in said housing having (1) an externally accessible water supply entrance and (2) a water supply exit;

a plurality of shower holes defined in said housing;

user operable valve means for selectively directing water flow from said water supply exit into either said shower holes or said cavity supply water inlet; and restricted cross-section orifice means located between said water supply exit and said valve means for limiting supply water flow rate and for increasing the velocity of water flow into said cavity to entrain tub water supplied thereto.

13. The apparatus of claim 12 further including a member defining a hydromassage passageway having an entrance orifice and a discharge orifice;

means mounting said member in said housing with said entrance orifice communicating with said cavity hydromassage outlet for discharging a hydromassage stream from said discharge orifice;

said mounting means including means supporting said member for movement of said discharge orifice along a travel path in response to said hydromassage stream being discharged therefrom.

14. The apparatus of claim 13 further including:

protuberance means mounted on said housing proximate to said discharge orifice travel path for engaging and massaging a user's body.

15. The apparatus of claim 14 further including weight means eccentrically carried by said member for enhancing the massaging of said user's body by said protuberance means.

16. The apparatus of claim 13 further including a membrane having front and rear faces; and means mounting said membrane rear face proximate to said discharge travel path for enabling said hydromassage stream to impact against said rear face without restricting the outflow from said discharge orifice.

17. Apparatus for use with a tap water source supplying pressurized water for selectively discharging a hydromassage water stream or a shower water spray, said apparatus comprising:

a first housing including a water supply passageway having a water entrance and a water exit, and an air supply passageway having an air entrance and an air exit;

a second housing including a cavity having a water inlet, an air inlet, a hydromassage outlet, and a shower outlet;

means mounting said first housing for movement, relative to said second housing, between first and second positions;

said mounting means in both said first and second positions orienting said first housing water exit in communication with said second housing water inlet for introducing a high velocity tap water flow into said cavity;

said mounting means in said first position orienting said first housing air exit in communication with said second housing air inlet for supplying air to said cavity for entrainment by said high velocity flow;

valve means mounted downstream from said first housing water exit and air exit for directing a water stream from said cavity through said hydromassage outlet when said first housing is in said first position and through said shower outlet when said first housing is in said second position;

a member defining a hydromassage passageway having an entrance orifice and a discharge orifice; and means supporting said member with its entrance orifice communicating with said hydromassage outlet for movement of said discharge orifice along a travel path in response to a water stream discharged therefrom.

18. The apparatus of claim 17 further including a membrane having front and rear faces; and means mounting said membrane rear face proximate to said discharge orifice travel path for enabling said hydromassage stream to impact against said rear face without restricting the outflow from said discharge orifice.

19. The apparatus of claim 17 wherein said water supply exit means includes a reduced cross-section orifice means for increasing the velocity of tap water flow into said cavity.

20. The apparatus of claim 17 wherein said housing defines a plurality of spaced externally opening shower holes; and shower passageway means communicating said shower outlet with said shower holes.

21. The apparatus of claim 20 further including pulse means mounted downstream from said shower outlet for periodically interrupting the water stream to said shower holes.

22. The apparatus of claim 17 further including a protuberance means mounted on said second housing proximate to said discharge orifice travel path for engaging and massaging a user's body.

23. The apparatus of claim 22 further including weight means eccentrically carried by said member for enhancing the massaging of said user's body by said protuberance means.

24. Apparatus for use with a water tub having a tap water source supplying pressurized water for selectively discharging a hydromassage water stream or a shower water spray, said apparatus comprising:

a first housing including a tap water supply passageway having a tap water entrance and a tap water exit;

a second housing including a cavity having a tap water inlet, a tub water inlet, and a hydromassage outlet;

a tub water passageway in said second housing having (1) an externally accessible tub water supply entrance and (2) a tub water supply exit means communicating with said cavity tub water inlet for supplying tub water thereto;

said second housing defining a plurality of spaced externally opening shower holes;

means mounting said first housing for movement, relative to said second housing, between first and second positions;

said mounting means in said first position orienting said first housing tap water exit in communication with said second housing shower holes for discharging a water spray therefrom;

said mounting means in said second position orienting said first housing tap water exit in communication with said cavity tap water inlet for introducing a tap water flow of sufficient velocity into said cavity to entrain tub water supplied thereto;

a member defining a hydromassage passageway having an entrance orifice and a discharge orifice; and means supporting said member with its entrance orifice communicating with said hydromassage outlet for movement of said discharge orifice along a travel path in response to a water stream discharged therefrom.

25. The apparatus of claim 24 further including a membrane having front and rear faces; and means mounting said membrane rear face proximate to said discharge orifice travel path for enabling said hydromassage stream to impact against said rear face without restricting the outflow from said discharge orifice.

26. The apparatus of claim 24 wherein said tap water exit includes a reduced cross-section orifice means for increasing the velocity of tap water flow into said cavity.

27. The apparatus of claim 24 wherein said second housing defines a shower outlet; and shower passageway means communicating said shower outlet with said shower holes.

28. The apparatus of claim 27 further including pulse means mounted downstream from said shower outlet for periodically interrupting the water stream to said shower holes.

29. The apparatus of claim 24 further including a protuberance means mounted on said second housing proximate to said discharge orifice travel path for engaging and massaging a user's body.

30. The apparatus of claim 29 further including weight means eccentrically carried by said member for enhancing the massaging of said user's body by said protuberance means.

31. Apparatus for use with a water tub having a tap water source supplying pressurized water for selectively discharging a hydromassage stream, said apparatus comprising:

a housing configured to be held in a user's hand, said housing defining an internal cavity having a supply water inlet, a tub water inlet, and a hydromassage outlet;

a tub water passageway in said housing having (1) an externally accessible tub water supply entrance and (2) a tub water supply exit communicating with said cavity tub water inlet;

a tap water supply passageway in said housing having (1) an externally accessible water supply entrance and (2) a water supply exit;

restricted cross-section orifice means located adjacent to said cavity supply water inlet for increasing the velocity of water flow into said cavity to entrain tub water supplied thereto;

a member defining a hydromassage passageway having an entrance orifice and a discharge orifice;

means mounting said member in said housing with said entrance orifice communicating with said cavity hydromassage outlet for discharging a hydromassage stream from said discharge orifice;

said mounting means including means supporting said member for movement of said discharge orifice along a travel path in response to said hydromassage stream being discharged therefrom;

a membrane having front and rear faces; and means mounting said membrane on said housing with said rear face proximate to said discharge orifice travel path for enabling said hydromassage stream to impact against said rear face without restricting the outflow from said discharge orifice.

32. The apparatus of claim 31 wherein said membrane mounting means is configured to readily permit manual removal of said membrane from said housing.

* * * * *